US008776316B2

(12) United States Patent
McRoskey et al.

(10) Patent No.: US 8,776,316 B2
(45) Date of Patent: Jul. 15, 2014

(54) DOOR SLAM PREVENTION DEVICE AND METHOD

(71) Applicant: Carlsbad Safety Products, LLC, Carlsbad, CA (US)

(72) Inventors: Daniel A. McRoskey, Rancho Santa Fe, CA (US); John W. McRoskey, Rancho Santa Fe, CA (US)

(73) Assignee: Carlsbad Safety Products, LLC, Carlsbad, CA (US)

( * ) Notice: Subject to any disclaimer, the term of this patent is extended or adjusted under 35 U.S.C. 154(b) by 0 days.

(21) Appl. No.: 13/673,931

(22) Filed: Nov. 9, 2012

(65) Prior Publication Data

US 2014/0007375 A1 Jan. 9, 2014

Related U.S. Application Data

(60) Provisional application No. 61/557,852, filed on Nov. 9, 2011, provisional application No. 61/576,790, filed on Dec. 16, 2011, provisional application No. 61/588,104, filed on Jan. 18, 2012.

(51) Int. Cl.
*E05F 5/06* (2006.01)

(52) U.S. Cl.
USPC ..... 16/85; 16/82; 16/83

(58) Field of Classification Search
CPC ..... E05C 17/00; E05C 17/46; E05C 17/54; E05C 17/44; E05C 17/025; E05F 5/02; E05F 5/06; E05F 5/08; E05F 5/18; E05F 5/00; E05Y 2900/132; E05Y 2201/212; E05Y 2201/224; Y10S 292/15; Y10S 292/19; Y10S 16/17
USPC ..... 16/82, 83, 85, 86 R, 86 A, 86 B; 292/289, 292/297, 298, 338, 229, 342, DIG. 15, 262
See application file for complete search history.

(56) References Cited

U.S. PATENT DOCUMENTS

| | | | | | |
|---|---|---|---|---|---|
| 900,621 | A | * | 10/1908 | Voight | 292/230 |
| 1,555,625 | A | * | 9/1925 | Beisler | 16/82 |
| 2,337,966 | A | * | 12/1943 | Borden | 16/85 |
| 2,464,637 | A | * | 3/1949 | Erd | 16/86 A |
| 2,722,443 | A | * | 11/1955 | Falk | 292/79 |
| 2,846,713 | A | * | 8/1958 | Shankwiler | 16/83 |
| 2,890,475 | A | * | 6/1959 | Carlson | 16/82 |
| 2,926,379 | A | * | 3/1960 | Klingler | 16/83 |
| 3,055,043 | A | * | 9/1962 | Luttner, Jr. | 16/86 B |
| 3,357,732 | A | * | 12/1967 | Seal | 292/60 |
| 4,110,867 | A | * | 9/1978 | Gwozdz | 16/82 |
| 4,196,924 | A | * | 4/1980 | Iseki | 292/79 |
| 4,765,662 | A | * | 8/1988 | Suska | 292/92 |
| 4,982,474 | A | * | 1/1991 | Kjellstrom | 16/82 |
| 5,123,685 | A | * | 6/1992 | Donovan | 292/262 |
| 6,244,636 | B1 | * | 6/2001 | Rissone | 292/202 |
| 6,327,743 | B1 | * | 12/2001 | Rashid et al. | 16/82 |
| 6,510,587 | B2 | * | 1/2003 | Urschel et al. | 16/83 |

* cited by examiner

*Primary Examiner* — Chuck Mah
(74) *Attorney, Agent, or Firm* — EIP US LLP

(57) ABSTRACT

A device for preventing injury between the surfaces of the leading edge of a closing door and an edge of a recess surrounded by a door jamb which surrounds the door when closed. The device features a housing and two sequential translating members which contact the recess edge and maintain a gap between it and the door edge for a dwell time which the second member remains between the two edges.

22 Claims, 20 Drawing Sheets

DOOR SLAM PREVENTION DEVICE AND METHOD

BACKGROUND OF THE INVENTION

1. Field of the Invention

This application Claims Priority to U.S. Provisional Application Ser. No. 61/557,852 filed on Nov. 9, 2011, and to U.S. Provisional Application Ser. No. 61/576,790 filed on Dec. 16, 2011, and to U.S. Provisional Application Ser. No. 61/588,104 filed on Jan. 18, 2012, of which all are herein incorporated in their respective entirety by reference.

The present invention relates generally to door slam prevention devices. More particularly, it relates to a component adapted to prevent a high velocity full closure of a door into a door jamb stop as well as providing controlled closure of the door thereafter. The device thereby can prevent potential injury to humans or animals which might have a body part in-between the door and jamb and helps to prevent damage to the door or jamb parts which a high velocity impact can cause.

2. Prior Art

A slamming door can cause many problems. Such slamming can be caused by wind in some cases, or accidental closure in others. On a boat or ship, movement or wind can initiate a high velocity closure or slamming of a door. The dangers of having a finger or hand smashed between a door jamb of a closing door are extreme. A crushing of fingers or toes or actual amputation can occur under the right conditions. Further, animals such as dogs and cats, can be severely injured and are unaware of such a potential for harm.

The dangers are further elevated if the closing door is a solid core or metal door or otherwise considerably heavy, even if, closing at a slow speed since force is the result of mass times its velocity. Even a lightweight door closing at a high velocity as it contacts the door jamb, can render extreme injuries to an unlucky occupant of the space between the door and jamb.

Whether moving at a high or low speed closure, such a closure is conventionally referred to as a slam or slamming. In an effort to slow door closure, many household, commercial, and public buildings employ dampeners such as hydraulic resistors or other means for providing a controlled, often slow, closure of an opened door. However, these efforts still may fall short. In some cases, such as in high wind, the wind forces may overpower the hydraulics and still cause the door to slam at a considerably high velocity, or, high force winds can breaks or disable some dampening type devices and cause a resulting injurious slam.

Additional dangers are also present even if a user's hands are clear of the door jamb. In the case of a high velocity door slam, once a user opens the door and begins to pass through the door way, the slamming door can strike the individual from the rear and cause considerable damage. Such damage may be increased if the door is of considerable weight or mass. If the door strikes the user in the rear while they are positioned on the opposite side of, or slightly within the door jamb, and not cognizant of their proximity to the plane occupied by the closed-door face, they can be thrown to the ground and suffer further injuries from the unsuspected impact. If the user is a young child, elderly, or happens to be struck in the head, the damage could unfortunately be fatal.

For one example, cruise ships and other passenger ships are known to employ fire safety doors often using hydraulics or other means for automatically closing the door after opening. These doors are often large and extremely heavy as is required for fire regulations. In open waters, wind may easily catch the large doors and as mentioned above, overpower the controlled closure provided by the hydraulics or other means, causing the door to slam.

Still further, the swaying or rocking of the vessel may additionally cause an ajar door to slam shut. Additionally, there are many doors on ships, just as in commercial buildings and homes, which have no protection against slamming due to an aversion by owners to the mounting and use of hydraulic dampeners or other means of slowing rotation of the door on the hinges. Even when hydraulic dampeners are employed, they can impart a false sense of security since such dampeners are frequently maladjusted, or rendered inoperable from age or lack of maintenance. Consequently, doors lacking functioning dampeners and the like, are prone to high velocity rotation from wind, children or adults pushing them, and movement of the structure housing them. The resulting slamming is as such, an injury waiting to happen.

Aside from damage to users, a slamming door may additionally cause damage to door hardware and even the door jamb frame and/or door jamb stop. Such repairs or replacements can be quite costly and extensive, and thus may go unrepaired for a time period, wherein the dangers are even further elevated.

Slamming hazards are also found in high velocity closing vehicle doors, cabinets, and drawers. For car doors, damage to metal or other components of the door are expensive and may compromise the integrity of the door. Also, due to the weight and protruding latches employed in car doors, hands or fingers caught between may be pulverized and not merely smashed. Cabinets and drawers are potential finger and hand hazards as they are often high traffic areas.

As such, there is a continuing unmet need for a door slam prevention device and method which provides controlled closure thereafter as needed for increased safety. Such a device should be easily engageable to an existing door. Such a device should not impede the closing of a door like a dampener so as to be employed where such hydraulic or other resistance is not wanted or needed. Such a device should be ideally adjustable to allow for user changes to operation from full prevention to no prevention. Still further, such a device should be employable to fail or move to a retracted position to allow door closure where it is needed or required to allow its use when not in a failure mode.

SUMMARY OF THE INVENTION

The device herein disclosed and described provides a solution to the shortcomings in prior art and achieves the above noted goals through the provision of a door slam prevention device having components providing one or a combination of a means for stopping a high velocity closing door to yield a gap for a determined dwell time, combined with a means for providing a controlled closure thereafter. In preferred modes of the device disclosed herein, the device may be engaged to the face of the door at either the handle side leading edge or the hinged side leading edge of a door which rotates toward a door jamb. However, in a particularly preferred mode, the device may be engaged at the top or uppermost leading edge of the door to be protected.

It must be further noted that those skilled in the art will appreciate that with slight modification the device may similarly be employed on car doors, cabinets and drawers without departing from the scope and overall intent of the device. As such, these and following descriptions should not be considered limiting.

Conventionally, for a closing door, the door's handle side edge moves slowly until it contacts the door stop positioned in a central area of the door jamb. At contact, the side surface of the door is registered in a position to allow the door's typical locking components to align and engage a recess in the central area of the jamb as well.

However, when a high rotating velocity causes the door to be slammed during closure, the leading door edge on the handle side frequently contacts the door jamb stop with such a great force as to damage or completely break one or a combination of the door jamb, the stop and/or the locking hardware components. Further, it is during such a high speed rotation where a user is most likely to be struck by the slamming door, or have a body part caught between the leading door edge and jamb, wherein the user may be seriously injured.

In one preferred mode of the device, a means for stopping a high velocity closing-door is provided by employing two translatable elongated members extending to an as-used position a distance form the housing to a distal end positioned past a side edge of a door. In the as-used position, as the high velocity closing door approaches the door jamb, a contact with the door jamb is made by a first elongated member sandwiched between a second elongated member and the jamb. This first member in use, contacts the door jamb frame and absorbs some of the generated force from the impact which deflects the first member to translate in a direction away from the frame or door jamb.

The second elongated member, parallel to the first, is maintained in an as-used or extended position, projecting past the edge of the door. In this position the second member provides a bump stop between the door and the door jamb frame forming a gap between the leading edge of the door and the door jamb. The door edge is thus held a distance away from the leading edge of the jamb, equal to the thickness of the second member, for the duration the second member is maintained extended from the housing.

The door jamb frame is typically considerably stronger and more durable than the door jamb stop which is positioned circumferentially on the central interior surface area of the frame. Thus, the door jamb frame is therefor considered less likely to be damaged by the impact with a slamming door. Further, one or both of the elongated members may be formed of a material configured to absorb some of the force of the slamming door.

The impact with the second elongated member transfers the force from the door momentum to the door frame and provides a means for maintaining a gap between the leading edge of the door and the jamb by preventing the rotating door from slamming into the seat of the door jamb stop within the interior of the jamb. A biased engagement of the second elongated member, to the first elongated member, provides a means for translating the second member in a direction away from the edge of the door and the door jamb frame, subsequent to striking it to prevent closure. This secondary translation allows the door to be fully closed in a controlled manner subsequent to holding the edge of the door away from the door jamb edge where it might cause injury. Further, if the door employs a hydraulic or other means for automatic closure, the controlled closure thereafter may be accomplished by those means subsequent to the secondary translation of the second member.

In another preferred mode the device is similarly positioned near the handle side edge, or leading edge of the door however, with the elongated member positioned a small distance from the edge, i.e., closer to the hinged side edge. In this resting position, the elongated member is maintained in position within the housing of the device by a spring or other biasing means.

In use, as the high velocity closing door approaches the door jamb, the force at the edge of a high velocity swinging door overcomes the spring bias and urges the elongated member to translate to a position where the distal tip is outward past the side edge of the door while concurrently stretching the spring. The elongated member is so positioned to provide a bump stop between the door and the door jamb frame as the door approaches the door jamb in a manner similar to the mode of the device described above. The impact of the jamb edge with the elongated member transfers the force of the door momentum to the door frame, and maintains the edge of the door a distance from the edge of the jamb, preventing the door from slamming into the door jamb stop for a dwell time.

With the centrifugal forces no longer present with the door ceasing rotation, the biasing force of the stretched spring, provides a means for biasing the elongated member to translate back to the resting position, out recessed behind both the leading edge of the door and the door jamb, such that the door can be closed in the conventional manner to a seated position abutting the stop In particularly preferred modes of the device, rather than being positioned in a horizontal disposition to contact the frame surrounding the door along the long side adjacent the handle, the device is positioned in a vertical mounted orientation positioned for contact with the jamb running parallel to the top edge of the door. In this mode, in a ready position prior to door closure, the two elongated members extend a distance past the top leading edge of the door. On a door closure, the first elongated member will contact the door jamb frame's horizontally disposed uppermost edge thereby providing a bump stop between the door and door jamb frame. This contact with the frame maintains a gap between door and jamb for a dwell time or duration. Thereafter the first member translates behind the door edge exposing the second member to a contact with the frame which stops the door to maintain the gap between the leading edge of the vertical and horizontal side edges of the door, and the frame. This gap is maintained for the dwell time of the second member in an extended position to maintain the gap for an equal duration of time.

The spring, engaged between the first member and now-translated second member, thereafter imparts sufficient force to bias and retract the second member. The dwell time of the second member in the extended position, and resulting gap, may be changed or adjusted by a change in the biasing force the spring communicates to the second member. This can be done by changing the spring length, size, or mounting points.

This mode of the device employing the top horizontal edge of the door and jamb, may be preferred in order to keep the device substantially out of the view of the public as for aesthetic purposes. Further, this mode provides a fail safe should the spring component biasing the second member fail to retract it to allow the door to close, since the second member subsequent frictional contact with the frame edge sufficient to hold it extended, will be pulled by gravity to the retracted position to allow door closure subsequent to striking the frame.

During fires or other disasters, in many venues it is a safety regulation that a door must be able to close within the jamb as may be needed to contain or secure an area. Therefore, this mode being substantially vertically mounted, gravity will act to bias the elongated members toward a stored position out of the way of the door jamb frame should the spring components fail.

Still further, this and other modes of the device may employ means for maintaining the device in one of three positions. This plurality of positioning includes an as-used or extended position providing the bump stop and subsequent closure, a stored or disable positioning wherein the device is clear of the door jamb frame, and a third position extending in a fashion where retraction is prevented, wherein the door is always prevented from closing. The members may be selectively locked or biased and held into any of the plurality of positions through a locking pin, button, or other suitable means.

It must be noted that in other preferred modes of the device, the force imparted for the translation of the elongated member may be accomplished via electronic means or other means for biasing. For example, the elongated member may be engaged to an electronic translating means, such as a solenoid or linear actuator, and may include accelerometers for switching that determine movement and/or if the velocity of the closing door is high enough to require an activation and employment of means for mainlining a gap between the door edge and jamb as well as for slam prevention as provided by the present invention herein.

In yet another preferred mode of the device, the elongated member may instead rotate from a first position to an as-used extended position between the leading edge of the door and door jamb frame by the centrifugal force generated by the high velocity closing door. Again, after the door is stopped and a gap maintained by the dwell time of the extended member, the elongated member is preferably biased back toward a first position, with its distal end behind the door edges such that the door can close in the conventional manner.

This mode of the device may be accomplished by employment of a spring loaded hinge operatively engaged to bias the elongated member in the first or retracted position. Thereafter this spring force providing a biasing is overcome by the centrifugal force of the slamming door in order to rotate the member to the as used position.

In still yet another preferred mode, the device may be employed adjacent the hinged side edge of the door. While this edge of the door moves at a slower speed than the handle edge due to a shorter arc, there is tremendous torque generated. Briefly, in this mode, as the high velocity swinging door approaches the door jamb, an elongated member is deployed at a position between the door and door jamb frame on the hinged side of the door. This positioning provides contact and a stop which prevents the door from rotating further, and the handle side edge of the door from slamming into the door jamb stop.

Still further, it is additionally preferred, that in all modes of the present invention discussed herein, the device should allow the door to close in the conventional manner, with no interference, when closing and rotating at a typical low velocity.

With respect to the above description, before explaining at least one preferred embodiment of the herein disclosed invention in detail, it is to be understood that the invention is not limited in its application to the details of construction and to the arrangement of the components in the following description or illustrated in the drawings. The invention herein described is capable of other embodiments and of being practiced and carried out in various ways which will be obvious to those skilled in the art. Also, it is to be understood that the phraseology and terminology employed herein are for the purpose of description and should not be regarded as limiting.

As such, those skilled in the art will appreciate that the conception upon which this disclosure is based may readily be utilized as a basis for designing of other structures, methods and systems for carrying out the several purposes of the present disclosed device. It is important, therefore, that the claims be regarded as including such equivalent construction and methodology insofar as they do not depart from the spirit and scope of the present invention.

It is an object of the invention to provide a door slam prevention device that absorbs and uses energy from a slamming door to aid in preventing damage to a door jamb stop and/or locking hardware.

It is an object of the invention to provide a door slam prevention device having a bump stop between a closing door and a door jamb frame to maintain a resulting gap between door and jamb edges.

It is an object of the invention to provide a door slam prevention device that allows the door to close in a conventional manner, with no interference, when the door is swinging at a typical low velocity.

A further object of this invention the provision of a device operating in a two-step process of full closure prevention where a first member absorbs force and translates out of the way, and a dwell time of a second member in an extended position, prevents full closure of the door for a duration of time which may be used by an individual to remove their hand or body part from the formed gap, before closure starts again.

An additional object of the invention is a device which will stop a slamming and maintain the safety gap to prevent injury, however should components fail, will still retract to allow closure subsequent to a first prevention thereof.

Additional objects of the invention will be brought out in the following part of the specification, wherein detailed description is for the purpose of fully disclosing the invention without placing limitations thereon.

BRIEF DESCRIPTION OF DRAWING FIGURES

Figure 29:
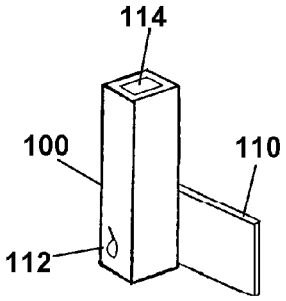
FIG. 29 shows a perspective view of still yet another preferred mode of the device depicting an elongated member rotatably engaged to a bracket member, and a biasing means, such as a spring, which when employed provides a means to bias and place the elongated member in the position shown.
Figure 29A:
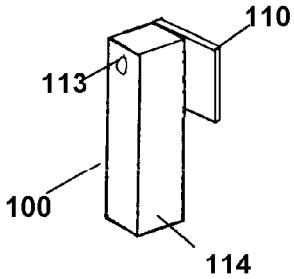

FIG. 29*a* shows another preferred mode of the device.

Figure 29B:
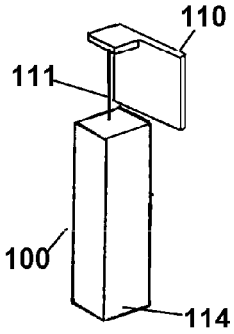

FIG. 29*b* shows yet another preferred mode of the device.

Figure 30:
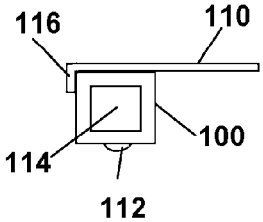

FIG. 30 shows a top view of the mode of the device of FIG. 29.

Figure 31:
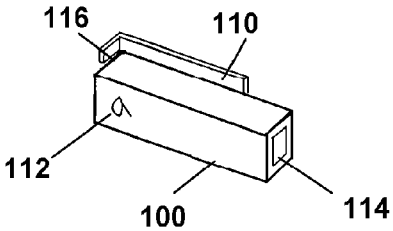

FIG. 31 shows the device of FIG. 29 in the as used position with the elongated member rotated outward due to the centripetal force of a high velocity closing door.

Figure 32:
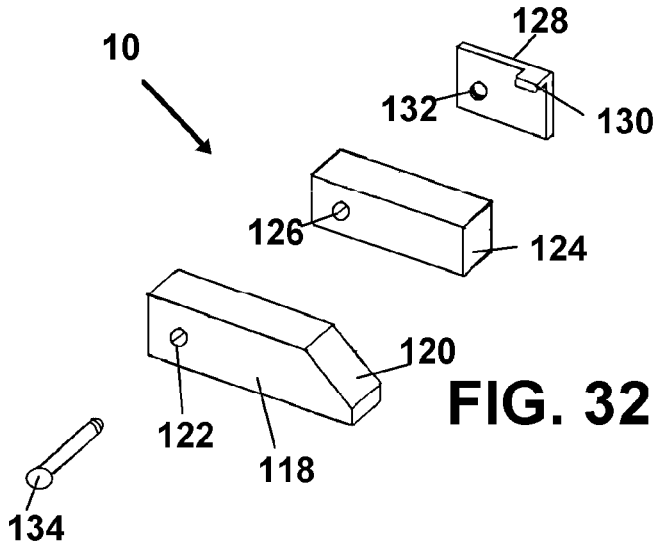

FIG. 32 shows an exploded view of yet another preferred mode of the device intended for employment adjacent the hinged side edge of a door.

Figure 33:
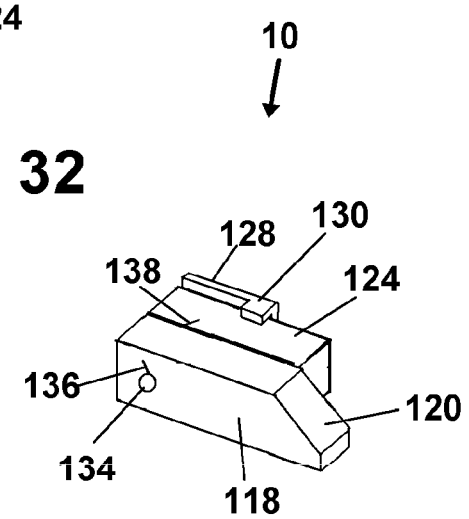

FIG. 33 shows a perspective view of the mode of the device of FIG. 32 in a complete assembly.

Figure 34:
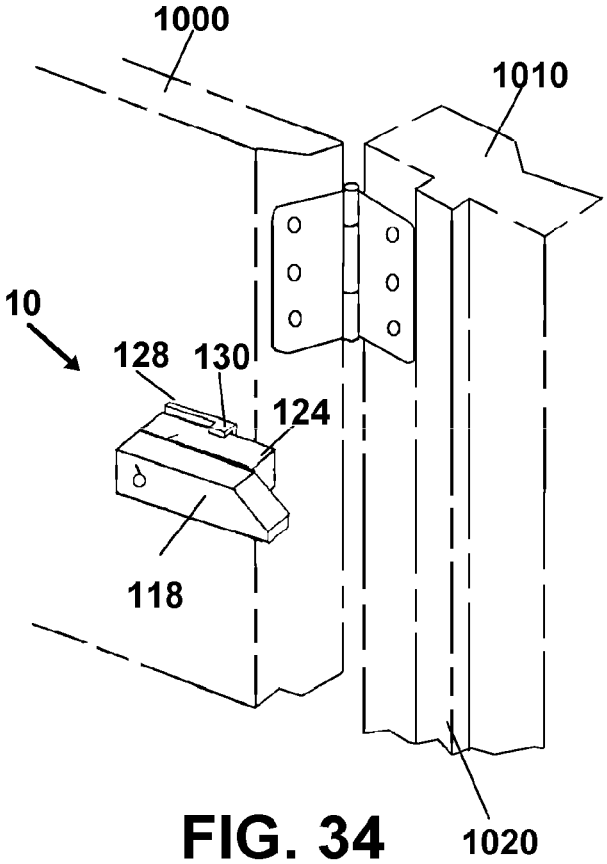

FIG. 34 shows a perspective view of the device of FIG. 33 in the as used position engaged adjacent to the hinged side edge of a door, the door is shown prior to high velocity closure.

Figure 35:
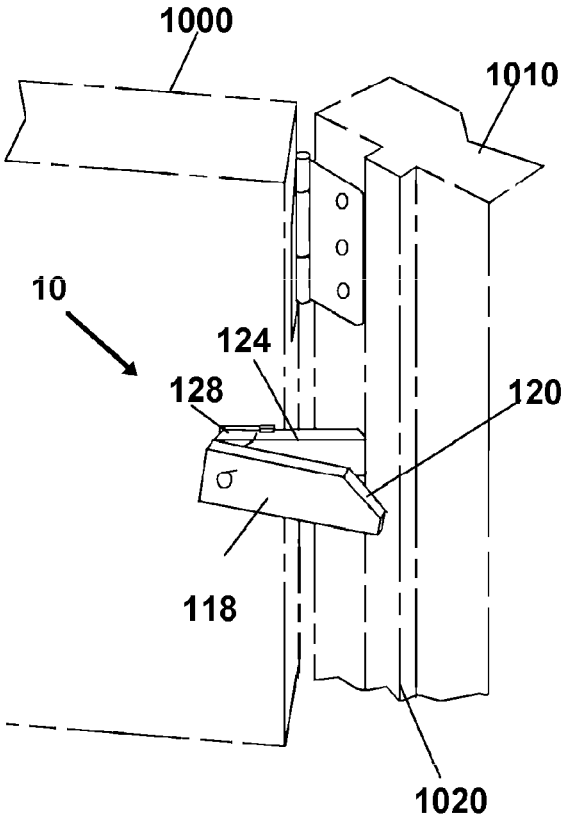

FIG. 35 shows a perspective view of the device of FIG. 33 in the as used position depicting a first elongated member being deflected by the door jamb stop and a second elongated member positioned between the door and door jamb frame providing a means for preventing the door from slamming against the door jamb stop.

Figure 36:
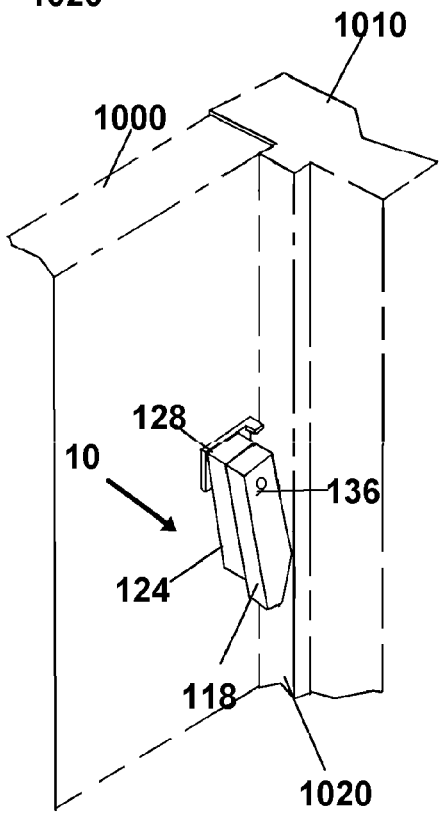

FIG. 36 shows a perspective view depicting the final closure of the door with the first and second members rotated downward and away from the door frame stop.

Figure 37:
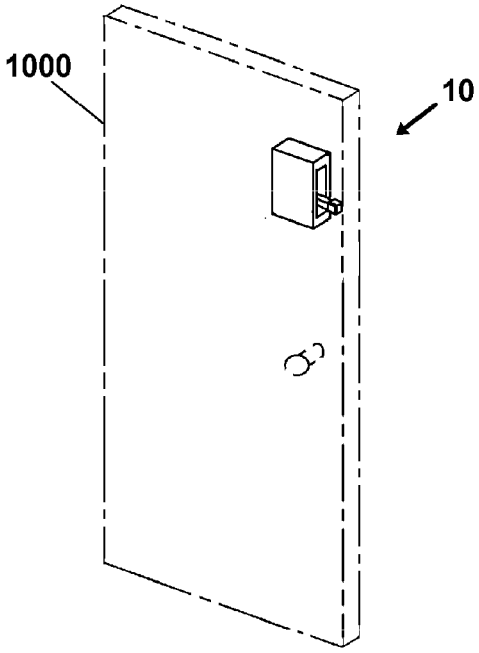

FIG. 37 depicts still another preferred mode of the device being substantially automatic and electronically controlled, shown in the as used position near the handle side edge of a typical door.

Figure 38A:
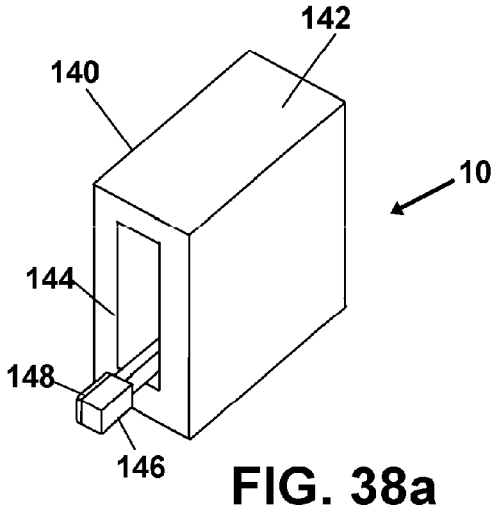

FIG. 38*a* shows a perspective view of the mode of the device of FIG. 37 detailing the housing and door stop component extending therefrom.

Figure 38C:
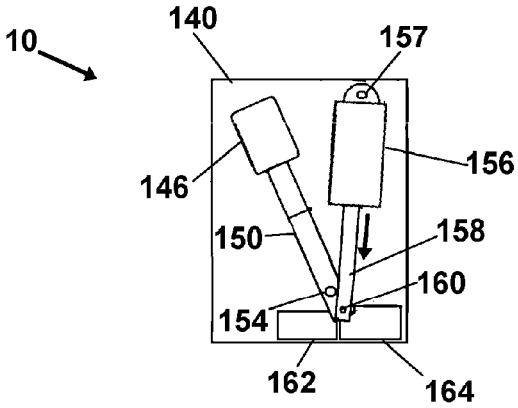
Figure 38B:
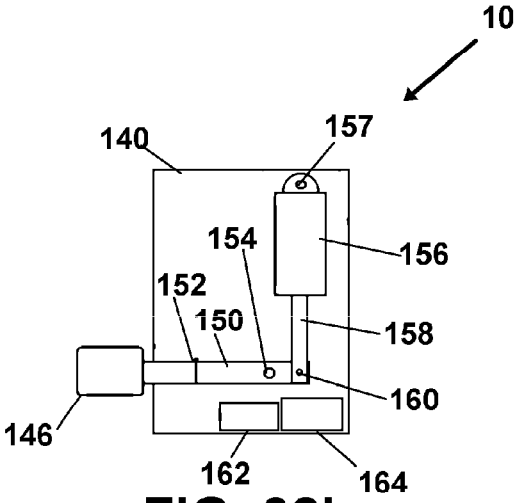

FIG. 38*b* shows a front view of the device of FIG. 38*a* with the front sidewall omitted to show the components housed within. The door stop component is shown in a rested or first position.

FIG. 38*c* shows another front view of the device of FIG. 38*a* with the stop component in a retracted, or second position.

Figure 38D:
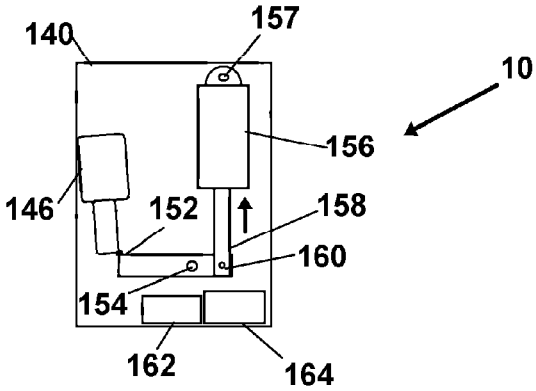

FIG. 38*d* shows a front view of the device of FIG. 38*a* with the stop component in a loaded or third position.

Figure 39A:
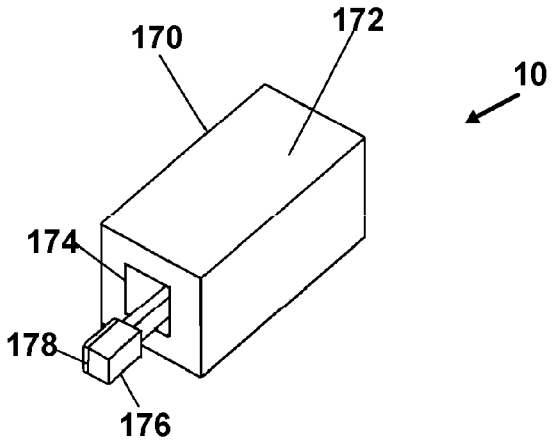

FIG. 39*a* shows perspective view of yet a further preferred mode of the device employing purely linear translation, detailing the elongated housing and door stop component extending therefrom.

Figure 39B:
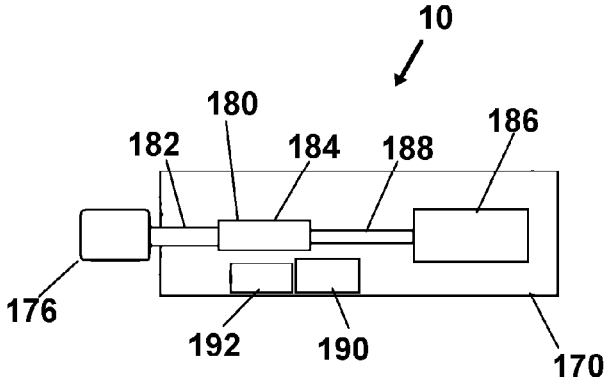

FIG. 39*b* shows a front view of the device of FIG. 39*a* with the front sidewall omitted to show the components housed within, the door stop component is shown in a rested or first position.

Figure 39C:
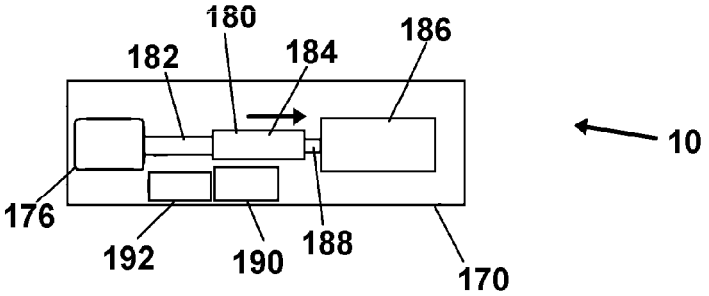

FIG. 39*c* shows another front view of the device of FIG. 39*a* with the stop component in a retracted, or second position.

Figure 39D:
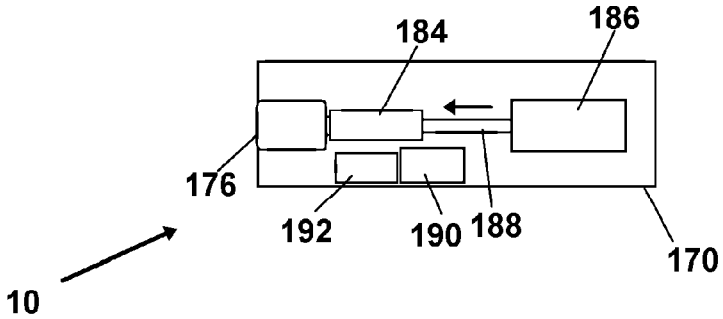

FIG. 39*d* shows a front view of the device of FIG. 39*a* with the stop component in a loaded or third position.

Figure 40A:
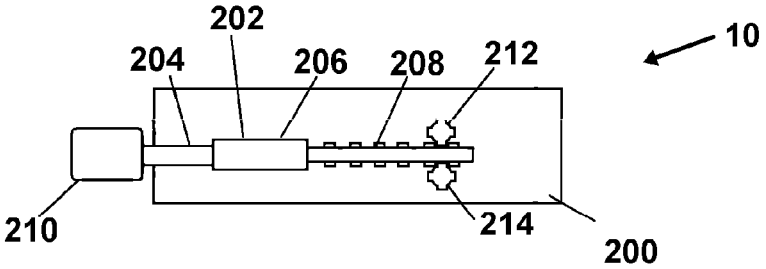

FIG. 40*a* shows a front view of yet a further preferred mode of the device employing a linear track. The front sidewall is omitted to show the components housed within and the components in a retracted position.

Figure 40B:
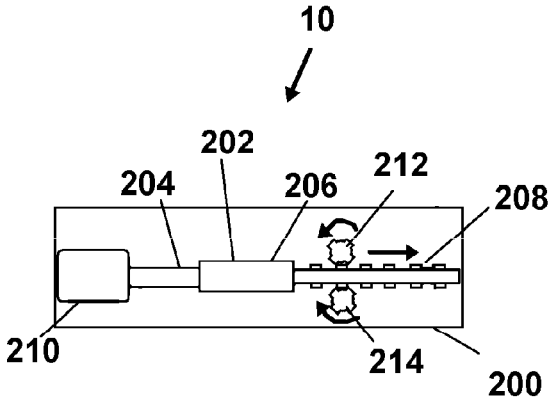

FIG. 40*b* shows a front view of the device of FIG. 40*a* with the front sidewall omitted to show the components housed within. The door stop component is shown in a retracted position.

Figure 40C:
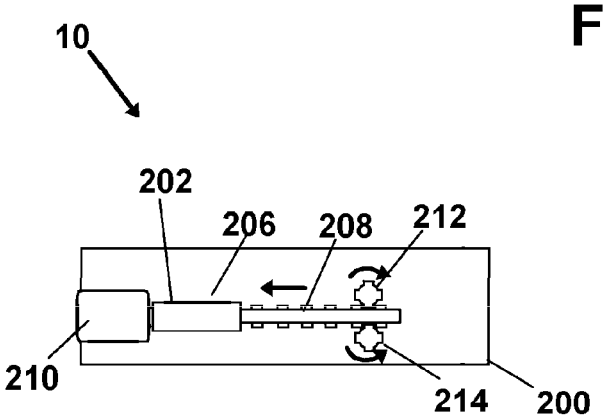

FIG. 40*c* shows a front view of the device of FIG. 40*a* with the stop component in a loaded or third position.

Figure 41:
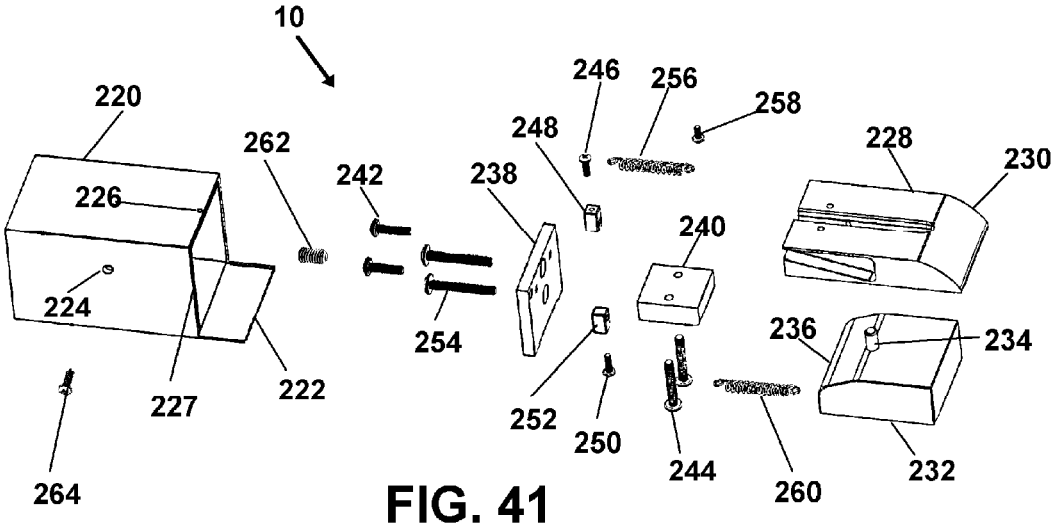

FIG. 41 shows an exploded view of yet another particularly preferred mode of the device especially well adapted for vertical mounting on the top or upper side edge of a door and employing improved means for spring tensioning and adjustment.

Figure 42:
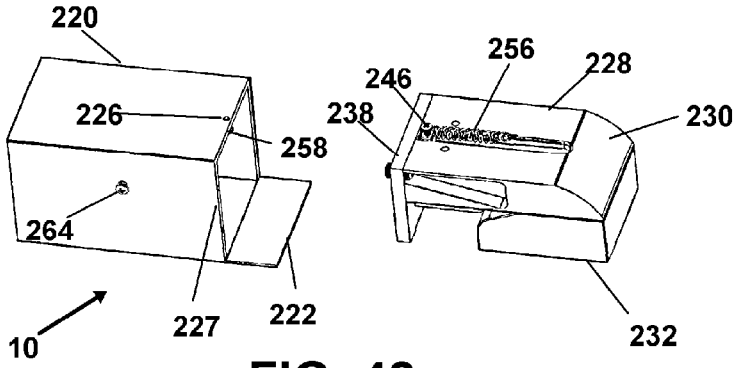

FIG. 42 shows a partially assembled view of the mode of the device of FIG. 41.

Figure 43:
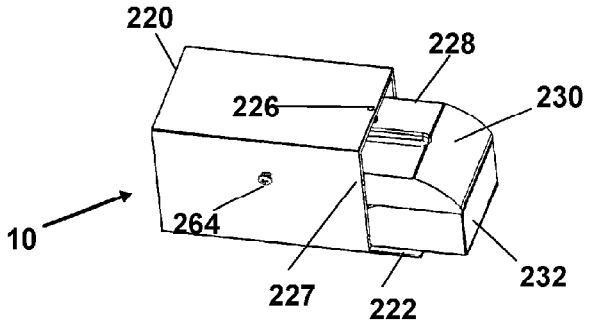

FIG. 43 shows a complete assembled view of the mode of the device of FIG. 41.

Figure 44:
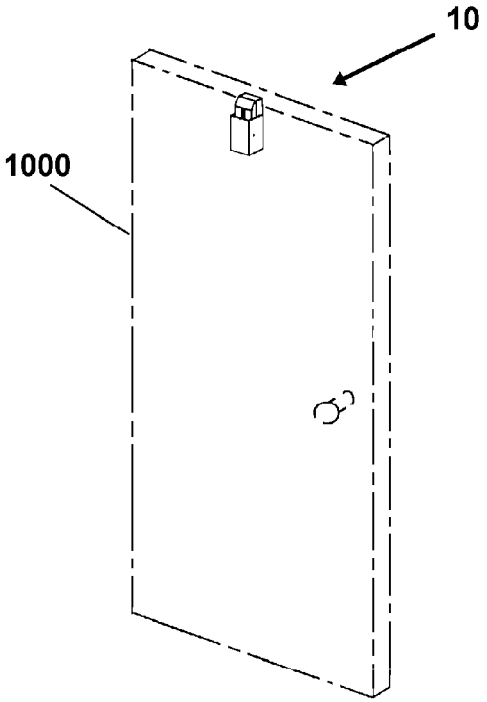

FIG. 44 shows a view of the device of FIG. 41 in the as used position on the uppermost side edge of a door.

Figure 45:
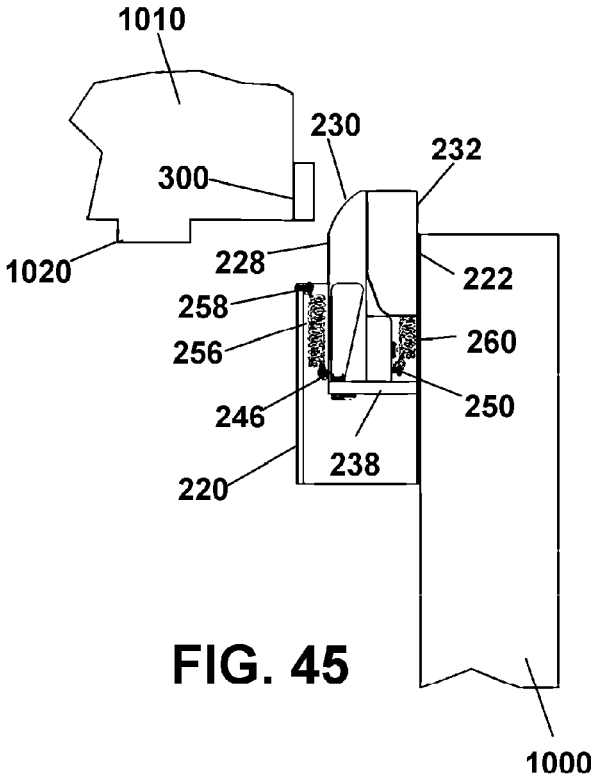

FIG. 45 shows a side view of the device in the as used position on a door as the door approaches the door jamb prior to the first elongated member contacting the striking plate on the door jamb frame.

Figure 46:
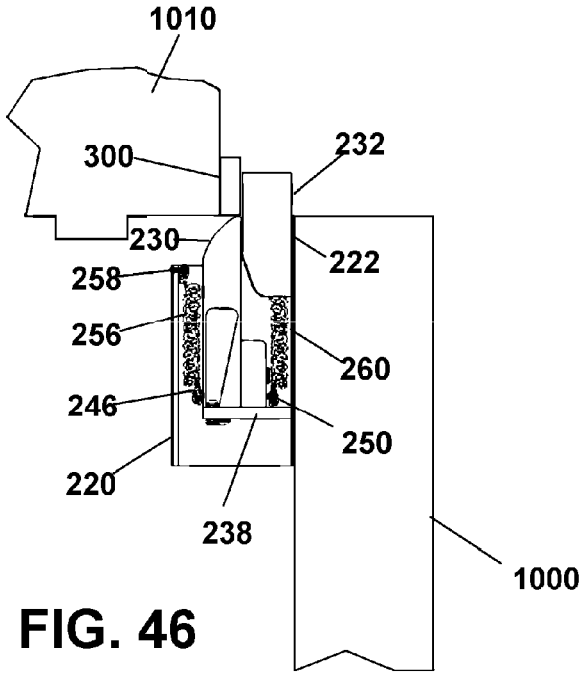

FIG. 46 shows a side view depicting the deflection of the first elongated member away from the door jamb frame.

Figure 47:
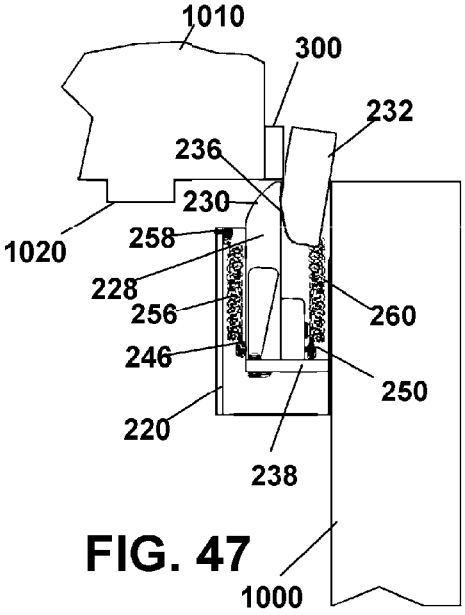

FIG. 47 shows a side view depicting the second elongated member providing a stop between the door and door jamb frame.

Figure 48:
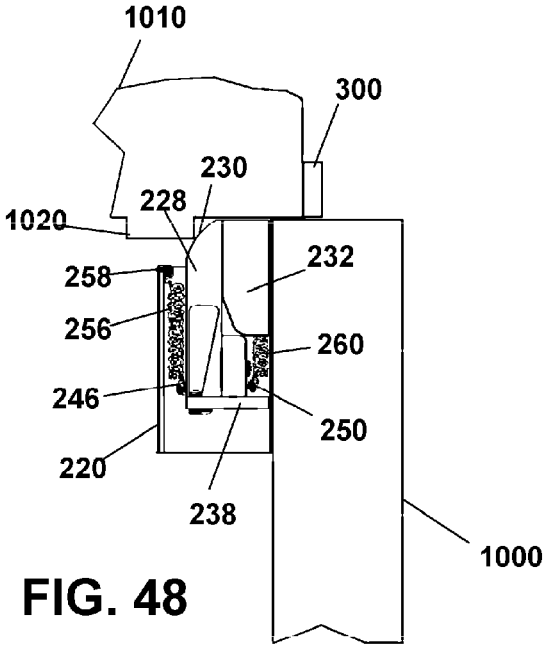

FIG. 48 shows a side view depicting the closure of the door with the first and second members translated away from the door jamb frame.

Figure 49:
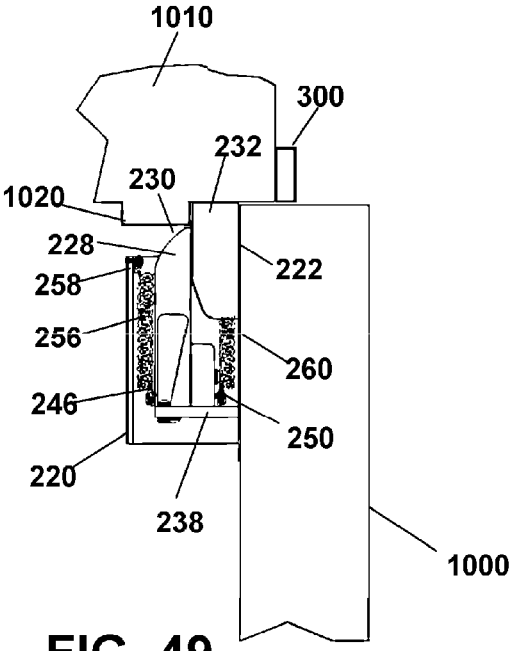

FIG. 49 shows a side view depicting the deflection of the first elongated member away from the door jamb stop.

Figure 50:
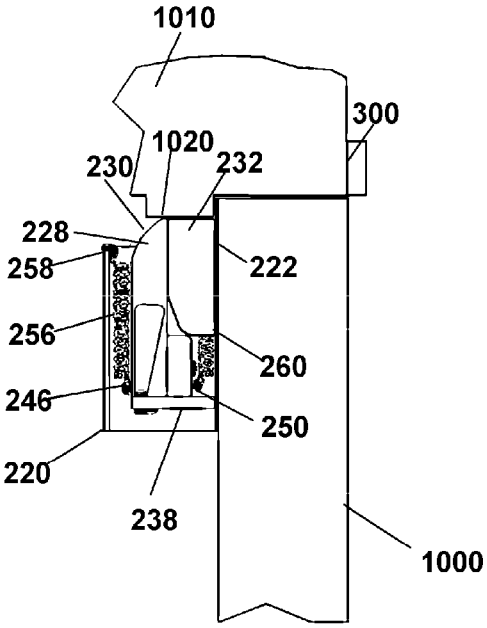

FIG. 50 shows a side view depicting the final closure of the door with the first and second members translated away from the door frame stop.

Figure 51:
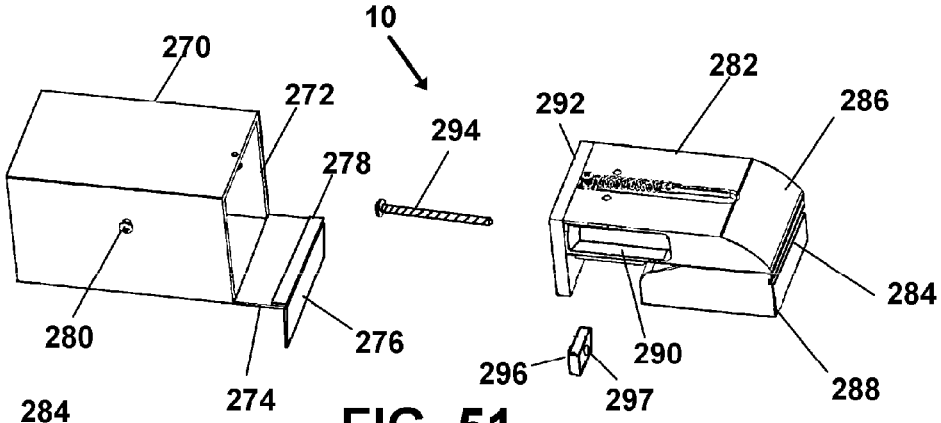

FIG. 51 shows a partially exploded view of still yet another particularly preferred mode of the invention employing means for adjusting the projection distance of the elongated members, and means for temporarily maintaining the elongated members in the stored position.

Figure 52:
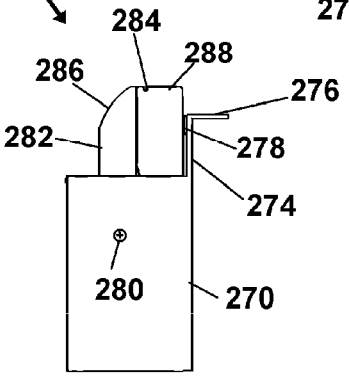

FIG. 52 shows a side view of the mode of the device of FIG. 51.

Figure 53:
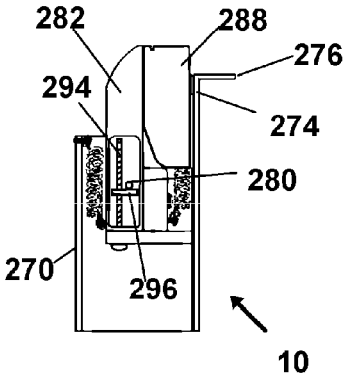

FIG. 53 shows a cut-a-way side view of the device of FIG. 52 showing the adjustment screw and stopper in a first position.

Figure 54:
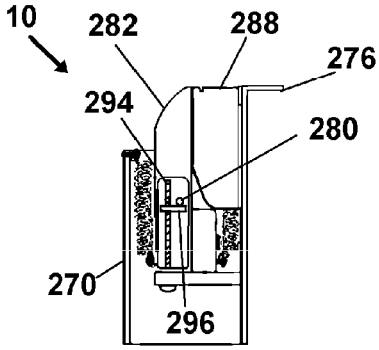

FIG. 54 shows a side view depicting the adjustment screw and stopper in a second position.

Figure 55:
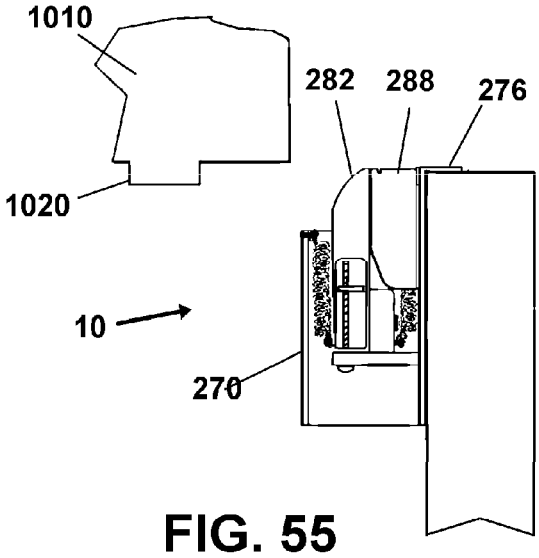

FIG. 55 shows the device of FIG. 54 in the as used mode engaged to the upper terminating edge of a door.

Figure 56:
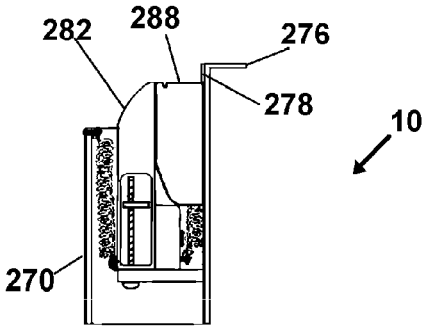

FIG. 56 shows the device in a temporary stored position.

Figure 57:
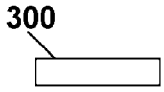

FIG. 57 shows a flexible planar member which is engaged to the door jamb stop for restoring the device to the as used mode, after being set into the temporary store position.

Figure 58:
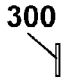

FIG. 58 shows a side view of the planar member.

Figure 59:
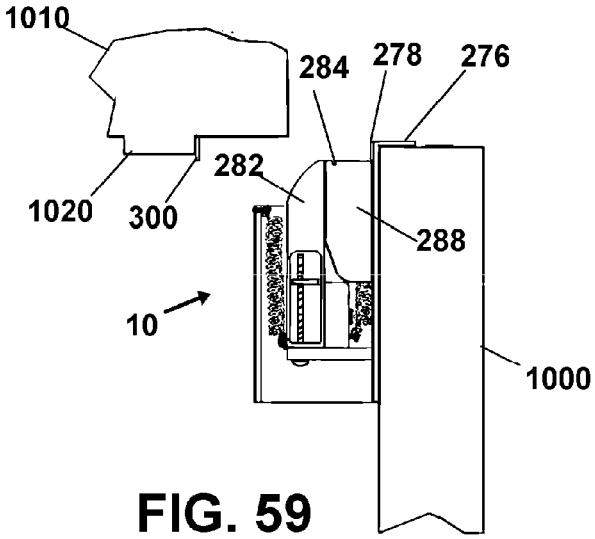

FIG. 59 shows the device approaching the door jamb in the temporary stored position, noting that the elongated members are positioned to allow full unimpeded closure of the door, and showing the planar member engaged to the door jamb stop.

Figure 60:
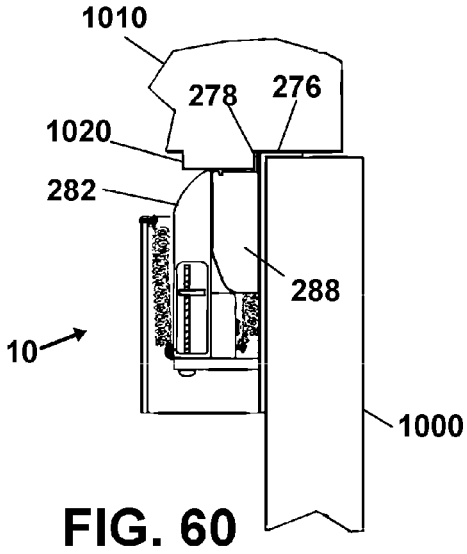

FIG. 60 depicts the full closure of the door, unimpeded by the elongated members.

Figure 61:
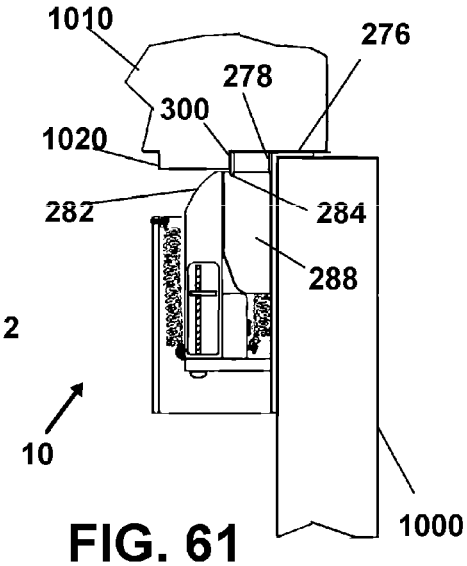

FIG. 61 shows the opening of the door, wherein the planar member engages a transverse slit on the upper surface of the second elongated member, for restoring the device to the as used position shown previously in FIG. 55.

Figure 62:
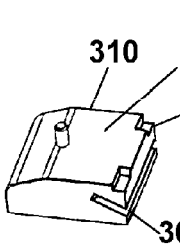

FIG. 62 shows another preferred mode of the second elongated member having means for shock absorbency.

Figure 63:
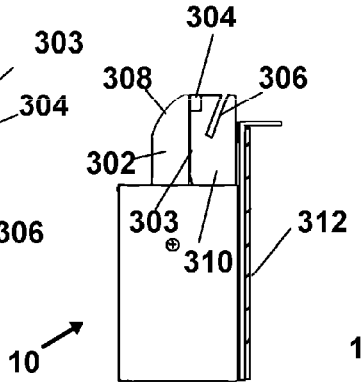

FIG. 63 shows a side view of the device employing the second elongated member of FIG. 62.

Figure 64:
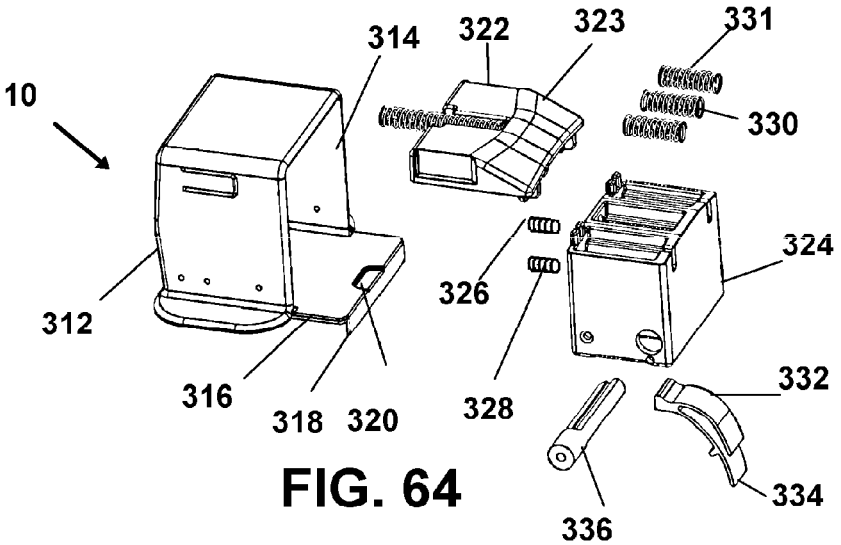

FIG. 64 shows an exploded view of yet another particularly preferred mode of the invention employing a means for adjusting the response of the second elongated members' relative the first elongated member.

Figure 65:
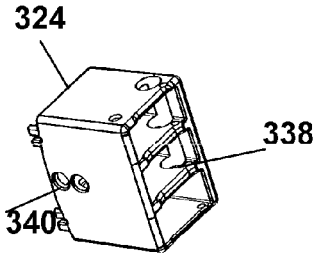

FIG. 65 shows a bottom perspective view of the second elongated member of the current mode of the device.

Figure 66:
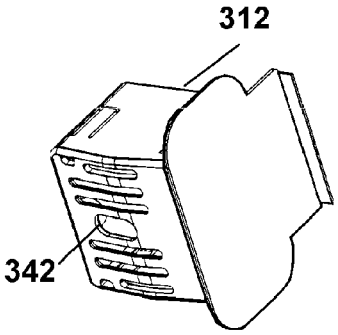

FIG. 66 shows a bottom perspective view of the housing of the current mode of the device.

Figure 67:
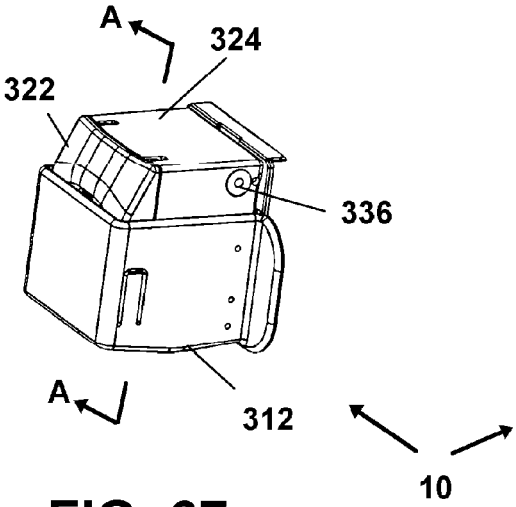

FIG. 67 shows a perspective assembled view of the current mode of the device.

Figure 68:
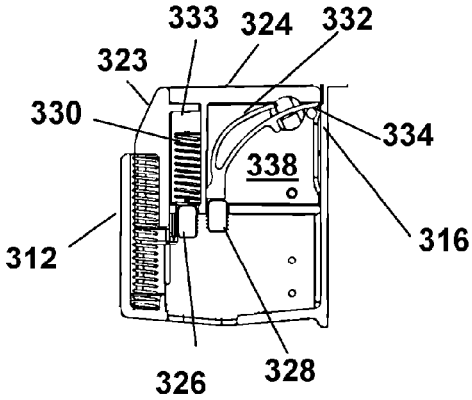

FIG. 68 shows a cross sectional view of the assembly of FIG. 67 along line AA of FIG. 67.

Figure 69:
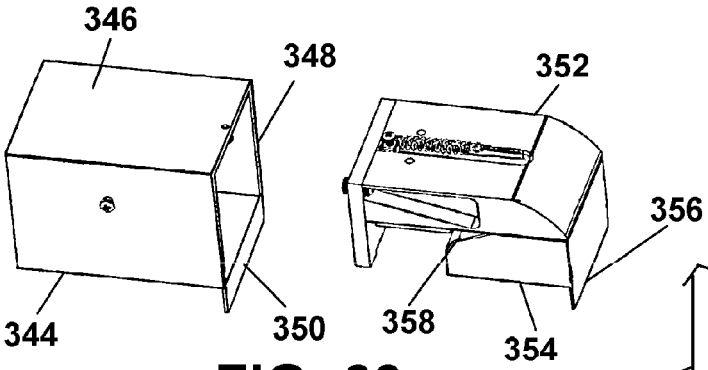

FIG. 69 depicts an exploded view of another mode of the device herein especially well adapted for shipboard use.

Figure 70:
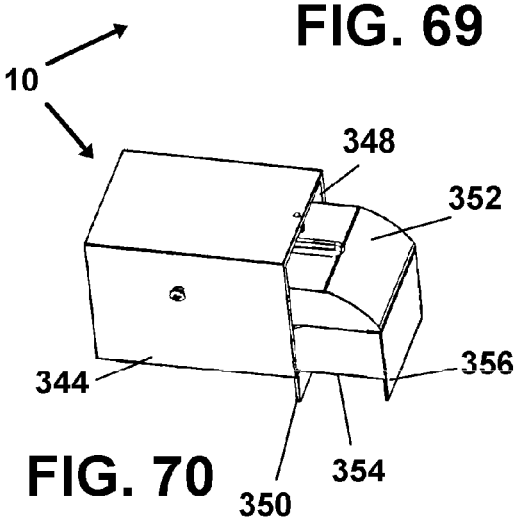

FIG. 70 shows an assembled view of the components of FIG. 69.

Figure 71:
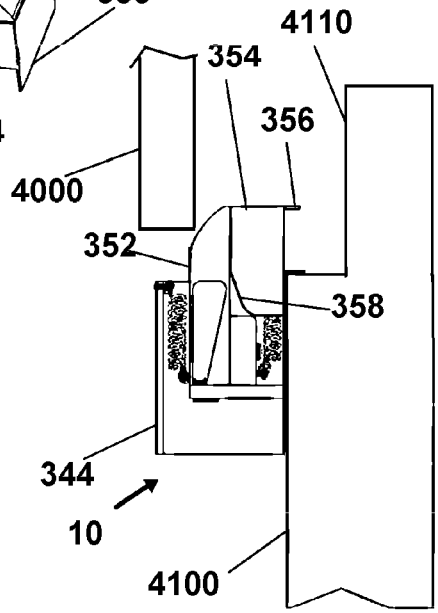

FIG. 71 depicts a side view of the device engaged to a door having a recess in its face, approaching a jamb.

Figure 72:
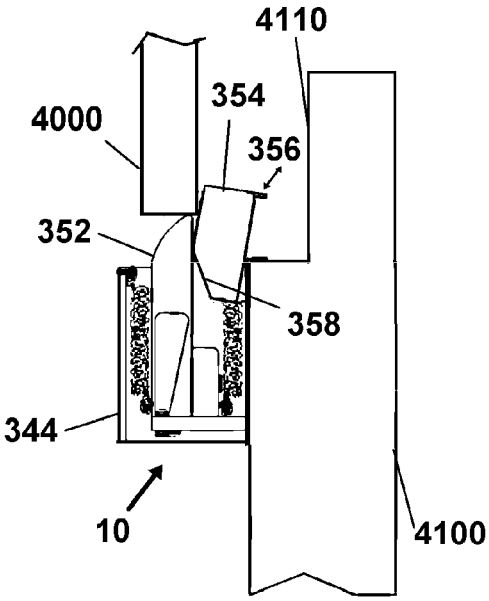

FIG. 72 shows the device of FIG. 71 subsequent to contact with the jamb and subsequent translation of the first member.

Figure 73:
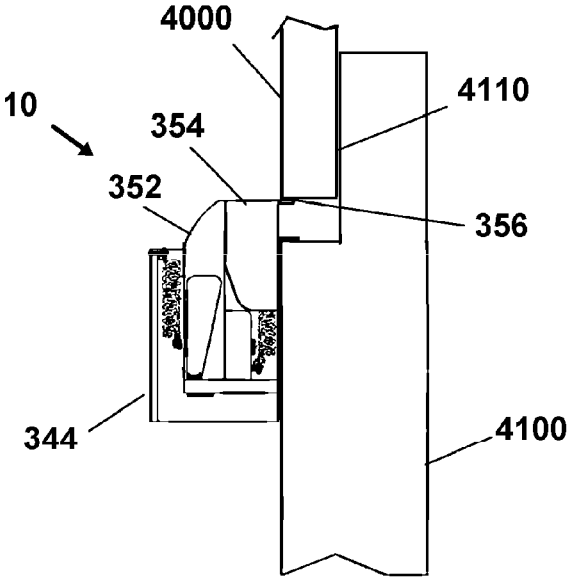

FIG. 73 the second member being biased to a retracted position subsequent to extension for a dwell time in the extended position.

DETAILED DESCRIPTION OF THE PREFERRED EMBODIMENTS OF THE INVENTION

It is an object of the present invention to maintain a gap between the leading edge of a closing door and that of a door jamb for a duration sufficient to allow a user to remove an appendage or body part therefrom and avoid injury. The gap is maintained through employment of means for preventing a high velocity closing door from slamming and concurrently receding within a door jamb into a stop for a dwell time whereafter a controlled closure into the door jamb is achievable in a normal fashion. As such, it must be noted that descriptions of the preferred modes of the device to follow are give merely to convey the overall scope as is concurrent with the intent of the invention. Therefor it is understood that those skilled in the art may realize various other means, or modifications of the preferred modes therein, for accomplishing the above noted goals and intentions without departing from the overall scope of the invention, wherein such various other means and modifications are anticipated.

In this description, the directional prepositions of up, upwardly, down, downwardly, front, back, top, upper, bottom, lower, left, right and other such terms refer to the device as it is oriented and appears in the drawings and are used for convenience only; they are not intended to be limiting or to imply that the device has to be used or positioned in any particular orientation.

Figure 1:
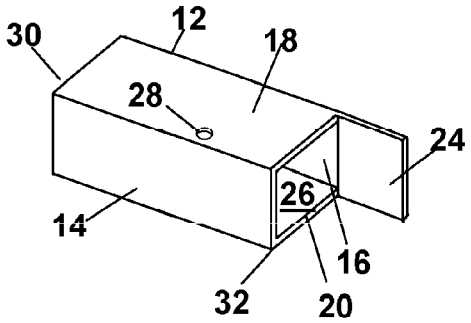
FIG. 1 shows a front perspective view of the housing component of a first preferred mode of the device.
Figure 2:
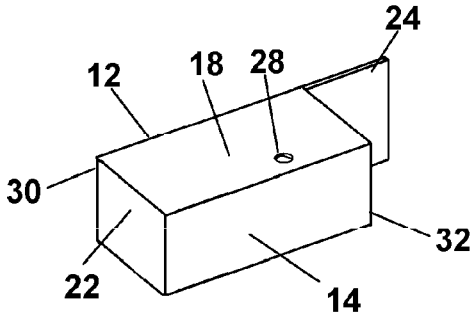
FIG. 2 shows a rear perspective view of the housing component of FIG. 1.

Now referring to drawings in FIGS. 1-73, wherein similar components are identified by like reference numerals, there is seen in FIG. 1 and FIG. 2 a housing component 12 of a first preferred mode of the present invention. The housing 12 comprising of a plurality of sidewalls, namely a first sidewall 14, second sidewall 16, top wall 18, and a bottom wall 20 extending from a first end 30 to a second end 32, and further defining an interior cavity 26. Preferably, the housing 12 and interior cavity 26 have a substantially square cross section, for example the housing 12 may be formed from a square tube with an endwall 22. Further, it is preferred that at least one sidewall, such as the second sidewall 16, extends a distance past the second end 32 of the housing 12 to define a portion 24 herein referred to as the sidewall extension 24, whose purpose and intent will be set for shortly. There is additionally a threaded aperture 28 communicating through the top wall 18, again whose purpose will be set for shortly.

Figure 3:
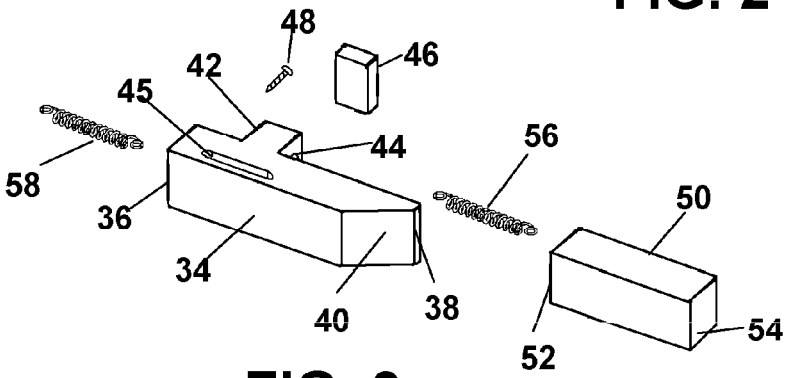
FIG. 3 shows an exploded perspective view of the housed components of the first preferred mode of the device depicting a first and second elongated members.

FIG. 3 shows an exploded perspective view of the components to be housed within the housing 12 defining the current preferred mode of the device 10. As shown there are a first elongated member 34 and a second elongated member 50. The first member 34 is defined as a rigid body preferably of a rectangular cross section and formed of a material such as a plastic or rubber. The distal end 38 includes a ramped portion 40 communicating with at least one sidewall of the body of the member 34.

Figure 4:
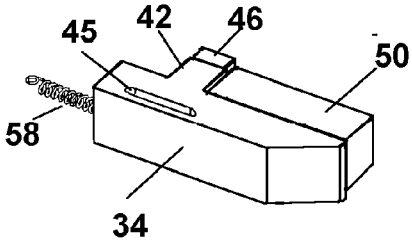
FIG. 4 depicts the components of FIG. 3 in the as used mode.
Figure 6:
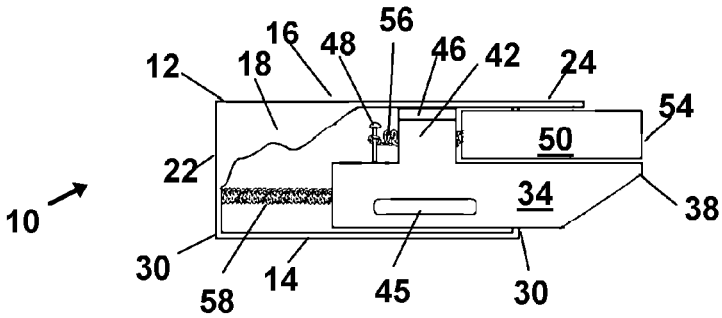
FIG. 6 shows a top view of the complete assembly of the device of FIG. 5, with the top sidewall of the housing partially omitted to show the interior.

A protruding portion 42 extends from the sidewall opposite the ramped portion 40 in a direction substantially orthogonal to the longitudinal length of the member 34. The protruding member 42 includes an aperture 44 communicating therethrough which is parallel the longitudinal direction. In use, a first spring 56 is engaged to set screw 48 and passes through the aperture 44 to an engagement with the second member 50. When assembled as shown in FIG. 4 and FIG. 6, screw 48 is engaged to the first member 34, and the spring 56 extends to an engagement to the proximal end 52 of the second member 50. The second member 50 is also defined as a rigid body preferably of a rectangular cross section. Also as can be seen in FIG. 4, a second spring 58 is engaged to the proximal end 36 of the first member 34.

Additionally, as can be seen there is a longitudinally extending cavity 45 on the top wall of the member 34, providing a kind of track. In use, the cavity 45 works in cooperative engagement with tracking pin 60 (FIG. 5) for limiting the translational movement of the member 34 relative the housing 12.

In use, springs 56, 58 provide a biasing means during translation of the members 34, 50, during operative employment of the current preferred mode of the device 10 described later in FIGS. 10-15. It must be noted that the biasing means may be any biasing means known in the art and is not limited to springs. For example, in a mode of the device employing electronics and accelerometers, the springs may be replaced with linear actuators.

Figure 5:
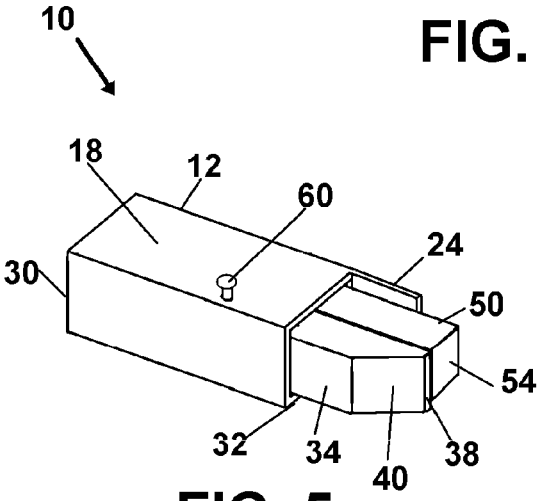
FIG. 5 depicts a complete assembly of the current preferred mode of the device.

FIG. 5 depicts a complete assembly of the device 10 with tracking pin 60 communicating through the aperture 28 of the top wall 18 of the housing and engaged within the cavity 45 of the first elongated member 34 providing a means for limiting the translational range of the member 34 relative the housing 12. It must be noted that FIG. 5 currently depicts the device 10 in a rested or first position, that is to say the springs 56, 58 are in an unbiased, relaxed state. In this position it is particularly preferred that the distal ends 38, 54 of the first and second members 34, 50 respectively, are positioned at a distance away from the distal edge of the sidewall extension 24 as is clearly shown in the figure.

FIG. 6 shows a top view of the complete assembly of the current preferred mode of the device 10, however with the top wall 18 of the housing 12 partially omitted to show the disposition of the components housed within. As is shown, the second spring 58 extends from its engagement with the proximal end 36 of the first member 34 to an engagement with the interior of the endwall 22 of the housing. The means of engagement may be any means known in the art.

As can further be seen, a cushion element 46 is engaged to the protruding portion 42 of the first member 34 and provides a dampener or cushion between the protruding portion 42 and the interior of the sidewall 16. The cushion element 46 is preferably a soft material such as a soft plastic, rubber, or sponge, however it is additionally preferred that the engaged contact surface between the element 46 and the sidewall 16 be low friction and can be accomplished by any means known in the art.

Again, as clearly shown in the figure, the distal ends 38, 54 of the first and second members 34, 50 respectively, in the first position shown, are at a distance protruding away from the distal edge of the sidewall extension 24 as is desired and whose purpose is disclosed shortly below.

Figure 7:
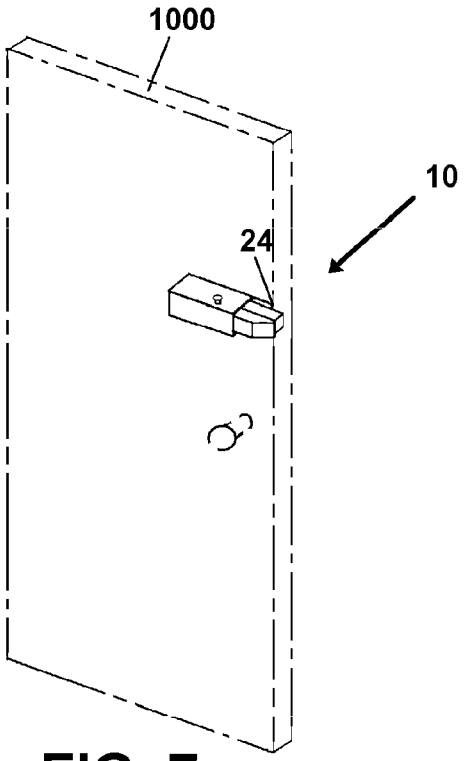
FIG. 7 shows the device in the as used position near the handle side edge of a typical door.

FIG. 7 shows a first preferred employed mode of the device 10 in the as-used position engaged adjacent the handle side edge of a door 1000. The door 1000 may be a conventional manual closing door or a door employing hydraulic or other means for automatic closure, such as a fire safety door. It is particularly preferred that the distal edge of the sidewall extension 24 be positioned substantially flush with the edge of the door 1000, as shown. Further, the device 10 is shown with the second sidewall 16 engaged to the face of the door 1000. The means of engagement may be permanent, such as a screw or bolt, or the second sidewall 16 may employ a strong adhesive strip or the like for near permanent or even removable engagement to the face of the door 1000.

Figure 8:
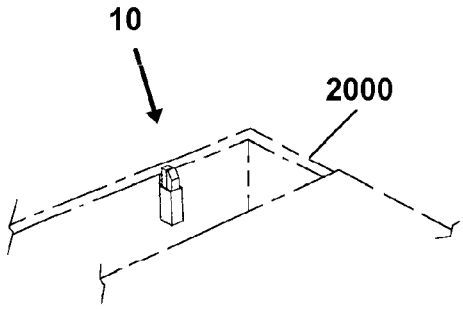
FIG. 8 shows the device in another as used position near the top outside edge of a drawer.

It is noted that the descriptions of FIGS. 10-15 shortly depicts the device 10 engaged to a door 1000, however, it is understood that the device 10 may be employed on other structures wherein slam prevention is desired. For example, the device 10 is shown in FIG. 8 engaged to the inside wall of a drawer 2000. In this mode the device 10 may be substantially scaled down in size relative to the mode shown in FIG. 7.

Figure 9:
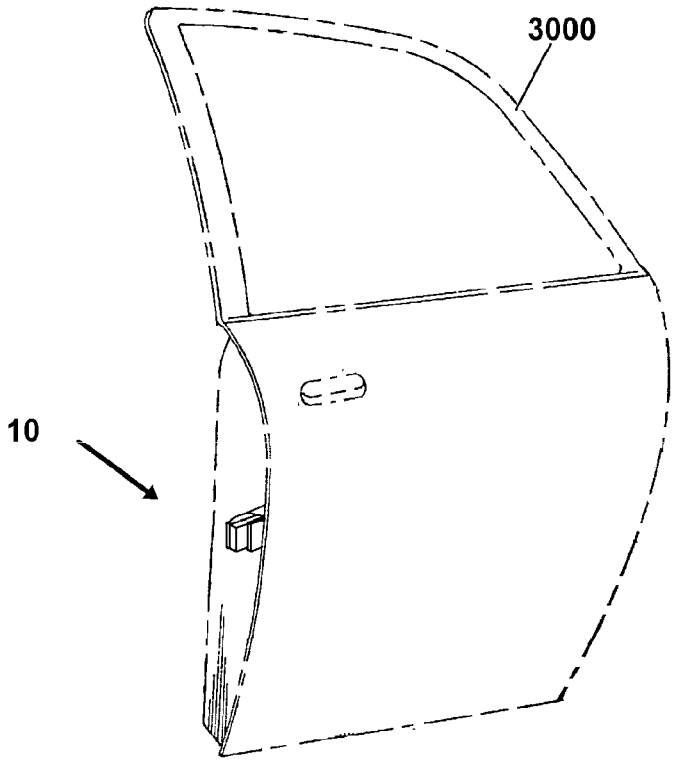
FIG. 9 shows the device in yet another as used position disposed near the handle side edge of a typical car door.

Further, FIG. 9 shows the device engaged adjacent the handle side edge of a car door 3000. For employment on a car door, those skilled in the art will appreciate that the car door 3000 and/or device 10 may require slight modification to work properly with the car door 3000 given the location of the conventional locking mechanisms for the door 3000 typically present on the handle side edge, and are anticipated.

Figure 10:
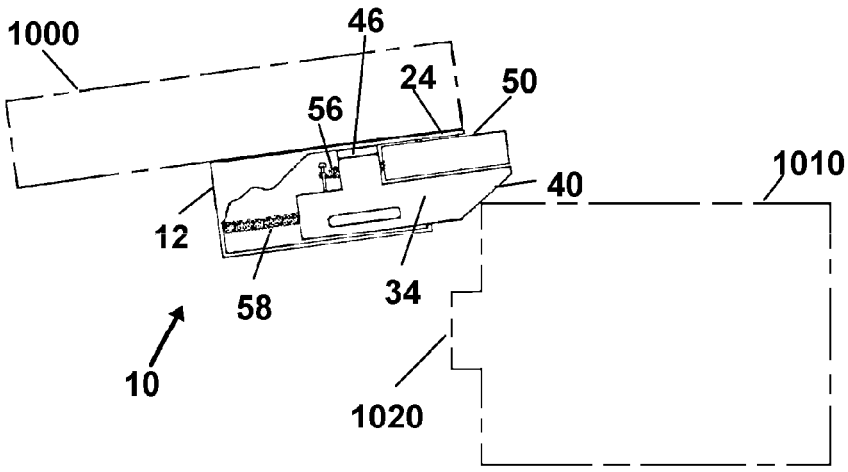
FIG. 10 shows a top view of the device in the as used position on a door as the door approaches the door jamb and the first elongated member contacts the door jamb frame.

The following figures provide a description of the modes of operation of the device 10 during the high velocity closure of a door 1000. Again the procedure described will be similar for other structures as well. FIG. 10 shows a top view of the device 10 engaged in the as used position, again noting that the distal edge of the sidewall extension 24 is flush with the edge of the door 1000. Shown is the initial impact of the ramped portion 40 of the first member 34 with the corner of the door jamb frame 1010. At this instant, the cushion element 46 is provided to cushion at least a portion of the impact that would normally be transferred to the housing 12, acting as a kind of shock absorber.

Figure 11:
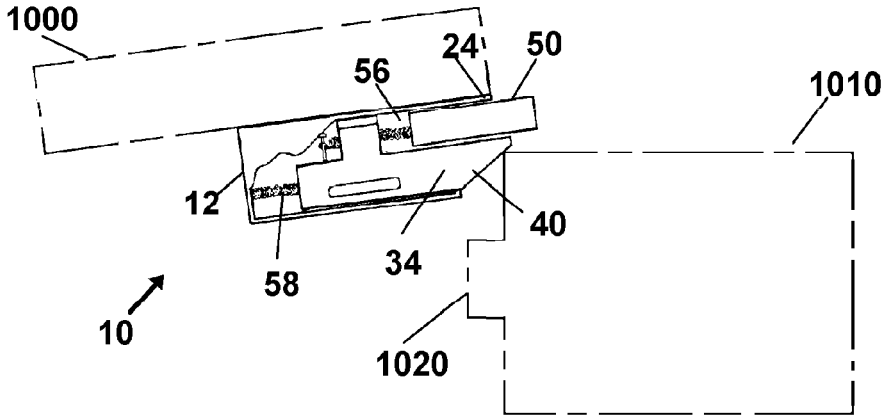
FIG. 11 shows a top view depicting the deflection of the first elongated member away from the door jamb frame.

A moment later, shown in FIG. 11, the first member 34 is deflected away from the frame 1010, stretching the first spring 56 and compressing the second spring 58. It is preferred that the contact surface between the first member 34 and second member 50 be substantially low friction such as to allow the first member 34 to be deflected without essentially dragging the second member 50 along with it. The second member 50 may also be maintained at the as used position due to the centripetal forces present in the high speed of the closure. Additionally, a slightly higher friction contact surface between the second member 50 and the interior of the sidewall 16 may be provided.

Figure 12:
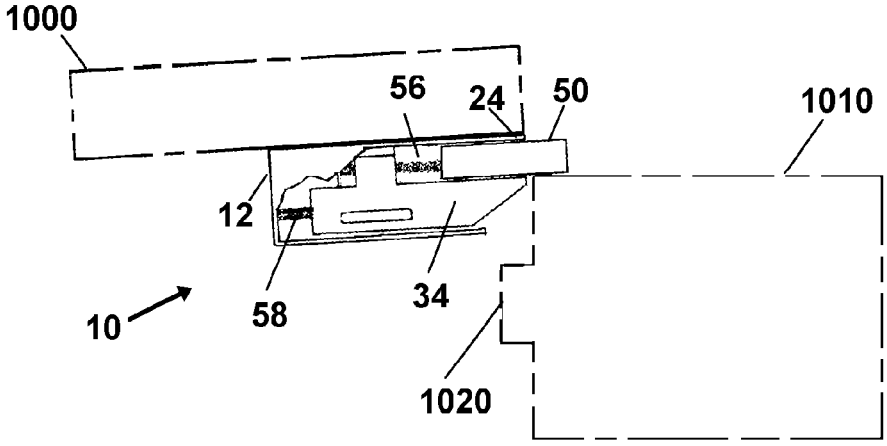
FIG. 12 shows a top view depicting the second elongated member providing a stop between the door and door jamb frame.

With the second member 50 remaining substantially stationary, as shown in FIG. 12, upon further closure of the door 1000, the second member 50 acts as a stop between the door 1000 and frame 1010, providing a means for communicating the momentum of the closing door 1000 into the door jamb frame 1010, further preventing damage to the door jamb stop 1020.

Figure 13:
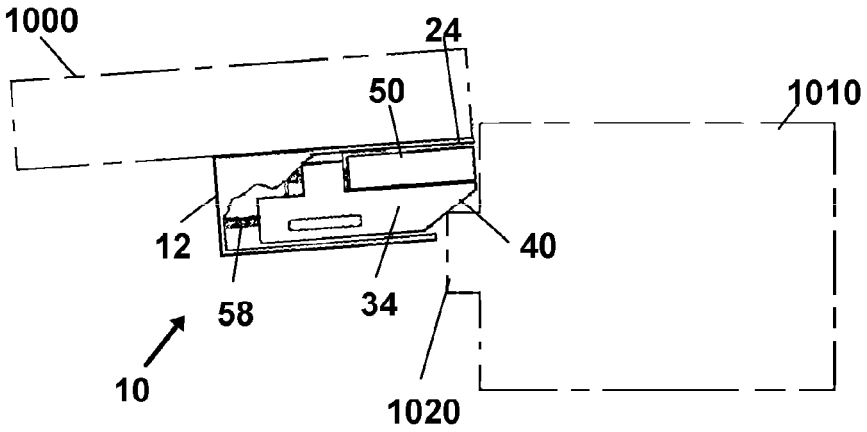
FIG. 13 shows a top view depicting the first elongated member contacting the door jamb stop.
Figure 14:
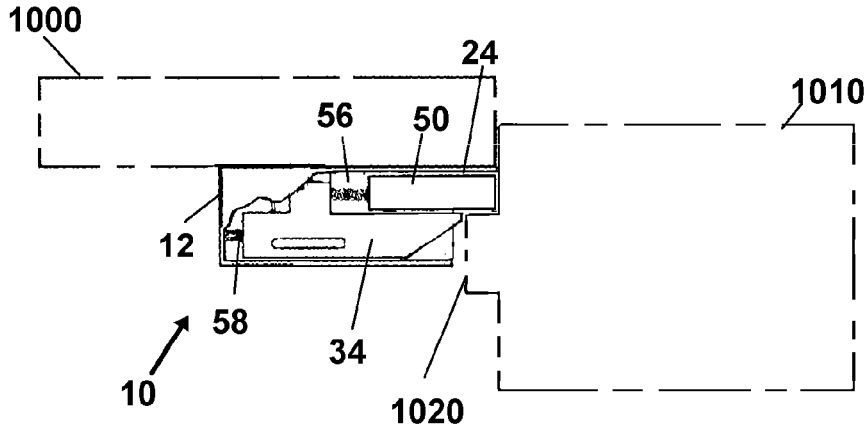
FIG. 14 shows a top view depicting the second elongated member providing a stop between the door and door jamb stop.
Figure 15:
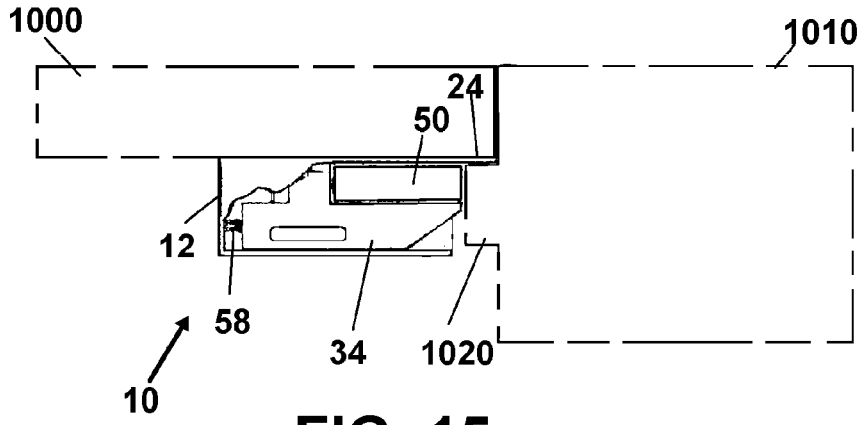
FIG. 15 shows a top view depicting the final closure of the door with the first and second members which are translated away from the door frame stop.

With the door's 1000 momentum stopped, the stretched first spring 56 provides a biasing force to draw the second member 50 into the housing 12 and adjacent the first member 34, shown in FIG. 13. As is an object of the present invention, a slow controlled closure of the door 1000 is then provided. As is shown in the current figure, the ramped portion 40 of the first member 34 contacts the door jamb stop 1020 where it is again deflected, stretching the first spring 56, and compressing the second spring 58. Shown in FIG. 14, the second member 50 then acts as a momentary stop between the door 1000 and door jamb stop 1020 providing a controlled closure of the door 1000, shown in the final closed position in FIG. 15. In the position shown, the second spring 58 is in a substantially compressed state, such that when the door is opened, the device 10 will return to the first position shown in FIG. 10.

Figure 16:
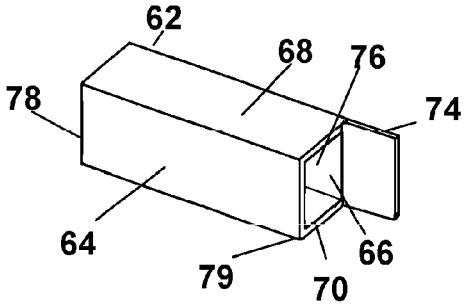
FIG. 16 shows a front perspective view of the housing component of another preferred mode of the device.
Figure 17:
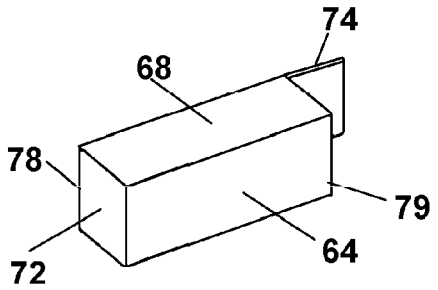
FIG. 17 shows a rear perspective view of the housing component of FIG. 17.

It should be noted, and is highly emphasized, that in the case of conventional slow closure of the door 1000, the first and second members 34, 50 will tend to translate in unison. For example, during a slow closure of the door 1000, with the device 10 in the starting first position of FIG. 10, upon contact of the ramped portion 40 of the first member 34 with the frame 1010, both members 34, 50, will be deflected in unison such that only the second spring 58 in compressed, and the device 10 then achieves the position shown in FIG. 13. Upon further closure, the device 10 will then achieve the position shown in FIG. 15. There is seen in FIG. 16 and FIG. 17 a housing component 62 of another preferred mode of the present invention. The housing 62 comprising of a plurality of sidewalls, namely a first sidewall 64, second sidewall 66, top wall 68, and a bottom wall 70 extending from a first end 78 to a second end 79, and further defining an interior cavity 76. Preferably, the housing 62 and interior cavity 76 have a substantially square cross section, for example the housing 62 may be formed from a square tube with an endwall 72. Further, it is preferred that at least one sidewall, such as the second sidewall 66, extends a distance past the second end 79 of the housing 62 to define a portion 74 herein referred to as the sidewall extension 74, whose purpose and intent will be set for shortly.

Figure 18:
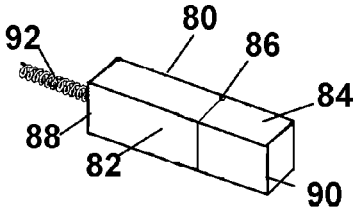
FIG. 18 depicts the housed components of the current preferred mode of the device.

FIG. 18 shows a view of the elongated member 80 intended to be housed within the housing 62. Generally, the member 80 is defined as a rigid body preferably of a rectangular cross section and formed of a material such as a plastic or rubber or other material suitable for the current application. Additionally the member 80 is comprised of a first portion 82 and a second portion 84 that are rotationally engaged by hinge 86 as shown. In use the member 80 acts a stop between a high velocity closing door and a door jamb frame, similar to the second member 50 of the previously disclosed preferred mode of the invention. It must be noted that the second member 50 of the previous mode of the device 10 may also be formed of at least two rotationally engaged portions providing an advantage described shortly.

Further, a spring 92 is shown engaged to and extending from the proximal end 88 of the member 80. Again noting that in other modes of the invention the spring may be replaced by other biasing means, for example a linear actuator.

Figure 19:
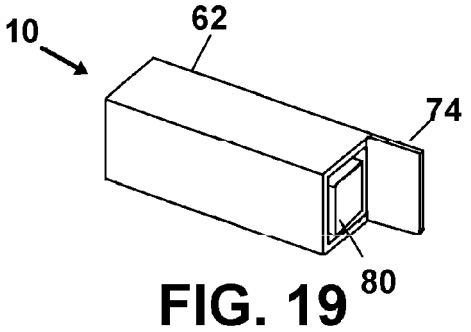
FIG. 19 depicts a complete assembly of the current preferred mode of the device.
Figure 20:
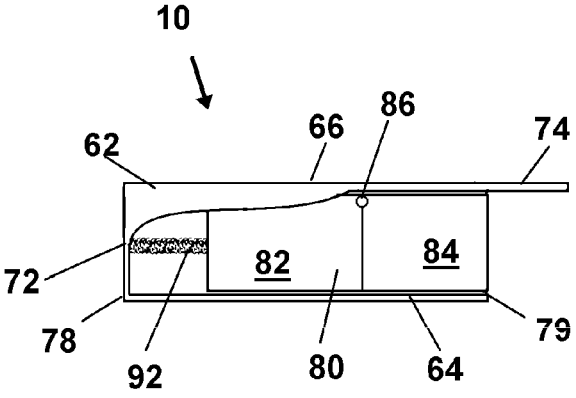
FIG. 20 shows a top view of the complete assembly of the device of FIG. 19, with the top sidewall of the housing partially omitted to show the interior, in this mode a spring is employed as a biasing means.

FIG. 19 and FIG. 20 show complete assemblies of the current preferred mode of the device 10. In FIG. 20, the top wall 68 is partially omitted. As can be seen the spring 92 is additionally engaged to the interior of the endwall 72 of the housing 62. The means of engagement can be any means known in the art. In the position shown the spring 92 is in an unbiased state, defining first, or relaxed position of the current mode of the device 10, with the distal end 90 of the member substantially flush with the second end 79 of the housing 62.

Figure 21:
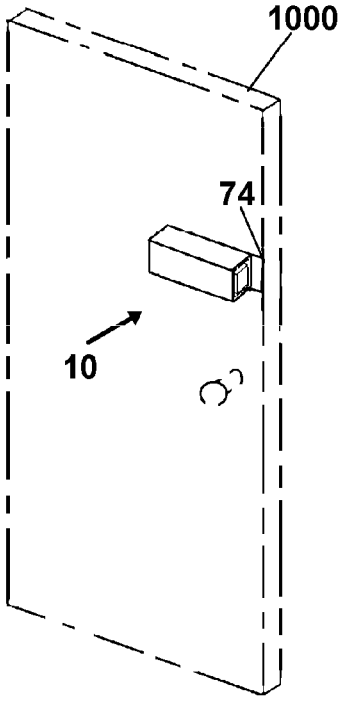
FIG. 21 shows the device in the as used position near the handle side edge of a typical door.

FIG. 21 depicts the device 10 employed on a door 1000. As is shown and preferred, the distal edge of the sidewall extension 74 is flush with the edge of the door 1000. Further, the engagement of the second sidewall 66 with the face of the door 1000 can be any means of engagement known in the art. The following FIGS. 22-26 show the operable positions of the device 10 during a high velocity closure.

Figure 22:
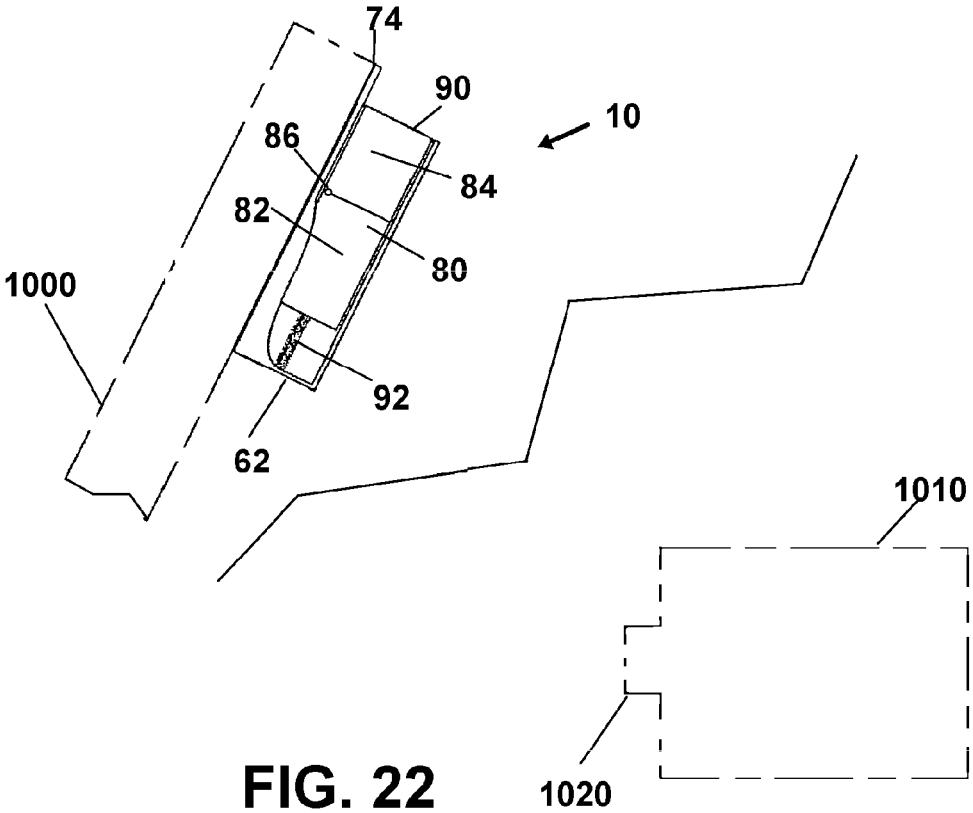
FIG. 22 shows a top view depicting the device in the as used position on a door prior to high velocity closure.
Figure 23:
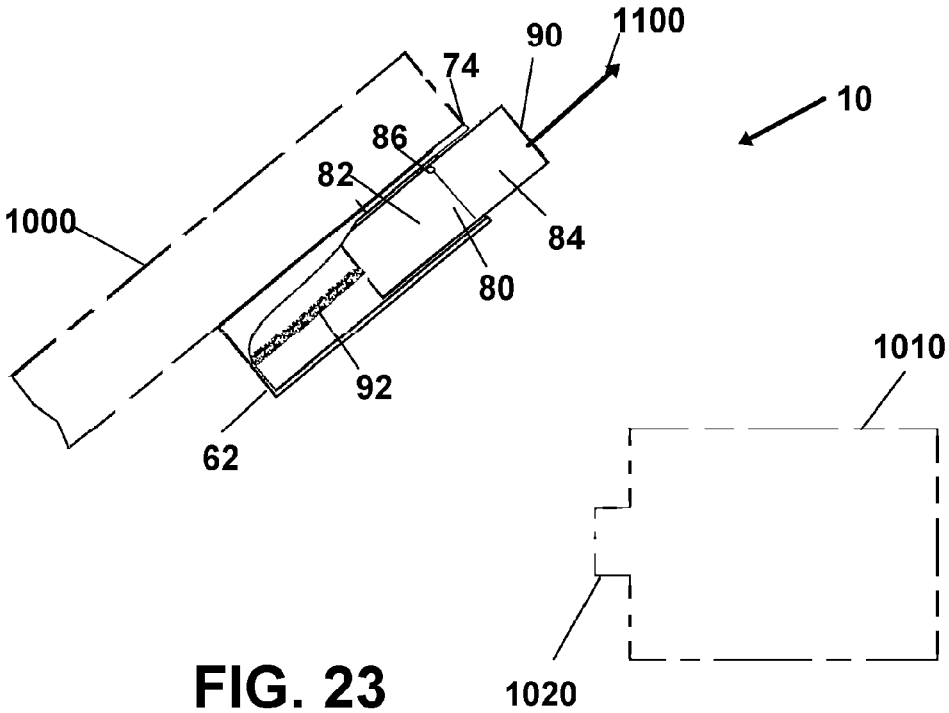
FIG. 23 shows a top view depicting the elongated member translated out and away from the door side edge due the centripetal force encountered during a high velocity closure, the door is shown approaching the door jamb.

FIG. 22 shows the device 10 in the first or rested position as it would be prior to a high velocity closure with the door 1000 substantially away from the door jamb frame 1010. As the door is rotated toward the jamb, and a high velocity is obtained, the centripetal force 1100 of the swinging door causes the member 80 to be drawn from the housing 62 to a position with the distal end 90 substantially past the edge of the door 1000, as shown in FIG. 23. At this instant the spring 92 is stretched, however, it is preferred that the spring force is calibrated to stretch given the centripetal force of the high velocity swinging door.

Figure 24:
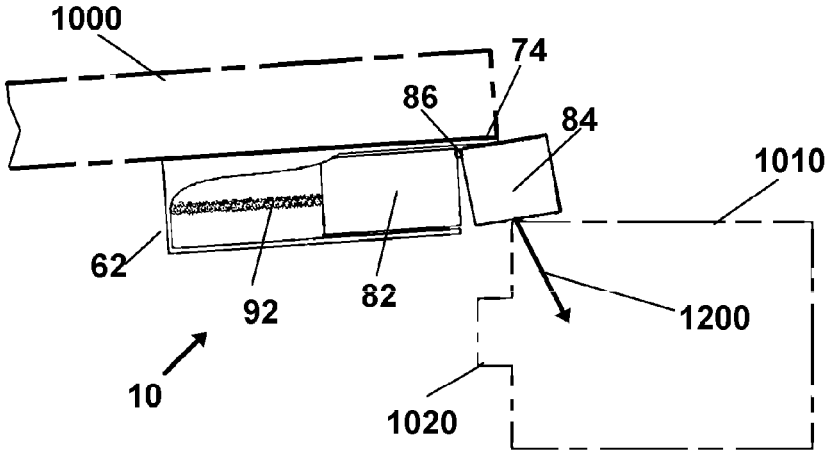
FIG. 24 shows a top view depicting the elongated member contacting the door jamb frame, providing a means for preventing the door from slamming into the door jamb stop.
Figure 25:
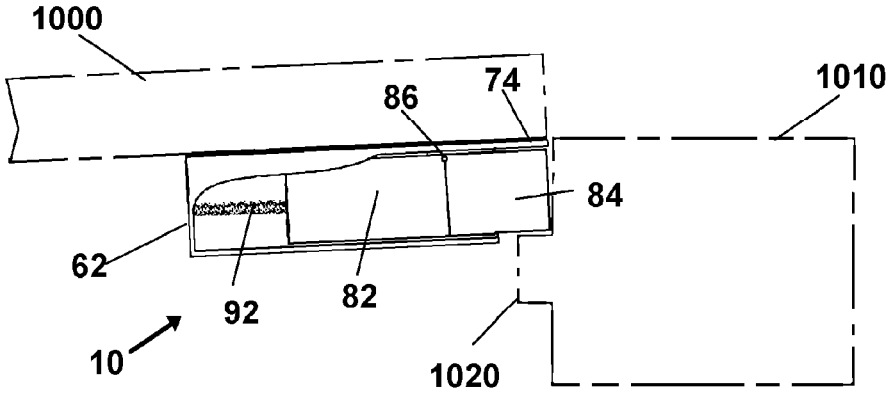
FIG. 25 shows a top view depicting the elongated member dwelling in an extended position and providing a stop between the door and door jamb stop.
Figure 26:
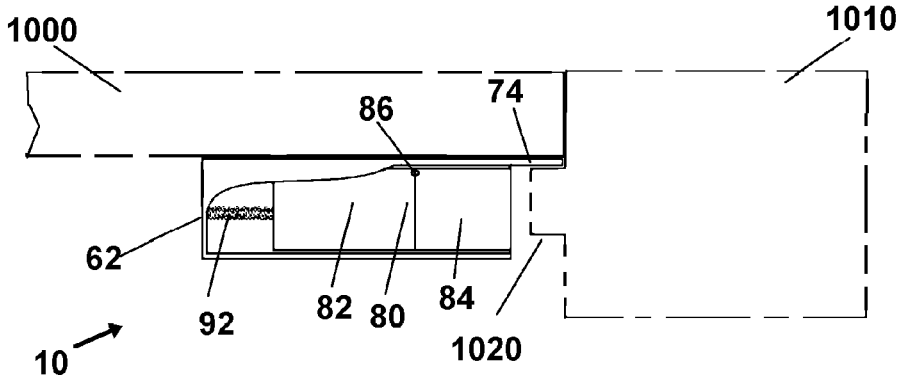
FIG. 26 shows a top view depicting the final closure of the door with the member translated away from the door frame stop.

In FIG. 24, with the member 80 in the as used, or extended position, the second portion 84 of the member 80 contacts the corner of the frame 1010. As is shown and preferred, the second portion 84 is slightly rotated at the hinge 86 such as to direct the force of the impact 1200 toward the center of the frame 1010 and limit any transfer of force to the housing 62 which could potentially damage the housing 62. Once the door 1000 is stopped and centripetal forces no longer present, the spring 92 provides a biasing force to draw the member 80 back toward the rested position. Still further, controlled closure is provided due to then further contact of the member 80 with the door jamb stop as shown in FIG. 25. Final closure of the door 1000 is depicted in FIG. 26 with the device 10 returned to the first or rested position.

Figure 27:
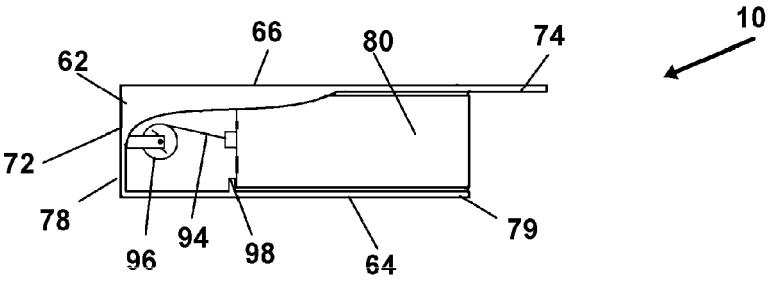
FIG. 27 shows a top view of yet another preferred mode of the device similar to that of FIG. 20, however, in this mode the basing means is provided by a flexible member, such as a rope, engaged to the elongated member and wrapped around a spring loaded pulley, shown biased in a first and retracted or rested position.
Figure 28:
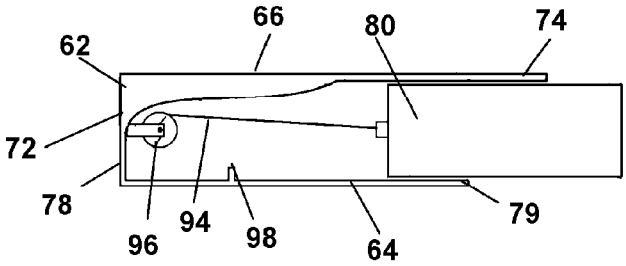
FIG. 28 shows the device of FIG. 27 in the as used position with the elongated member translated and extended outward from the housing from the centrifugal force of a high velocity closing door.

As an alternative means for providing a biasing force, the spring 92 of the mode of the device 10 of FIG. 20 is replaced with a flexible member 94 wrapped around a spring loaded pulley 96 as shown in FIG. 27. The flexible member 94, such as a rope or lanyard, is engaged to the member 80 and extends to successive wraps about the spring loaded pulley 96. The pulley 96 provides a biasing force to draw the member 80 toward the first end 78 of the housing 62 however a stop 98 is provided to maintain the end of the member 80 flush with the second end 79 of the housing 62. FIG. 28 shows the device 10 in the as used position as would be obtained during the presence of the centripetal force of a high velocity closing door.

FIG. 29-31 show still yet another preferred mode of the device 10 wherein an elongated member 100 is rotationally engaged 112 to bracket component 110. In this mode the device 10 would be positioned near the handle side edge of a door with the distal edge of the bracket 110 positioned flush with the door edge. In FIG. 29, the rotational engagement 112 is preferably a spring loaded hinge 112 provided to bias the member 100 in a substantially upright first position against a stop 116 of the bracket 110 shown in FIG. 29. The member 100 is also shown with a weighted distal end 114, such that as the high velocity door approaches the door jamb, the member will tend to overcome the spring force and rotate to the as used position shown in FIG. 31. In this position the member 100 acts as a stop between the door and door jamb frame as previously described. Again, once the door is stopped, the spring hinge 112 will bias the member 100 to the first position of FIG. 29 to allow the door to close.

FIG. 29*a* shows an additional preferred mode of the device 10 wherein the member 100 is engaged to the bracket 110 by an unbiased hinge 113 such as a pin. The member 100 additionally may include a weighted distal end 114 however it is oriented substantially downward. In use, the centripetal force of the swinging door will cause the member 100 to rotate upward to the as used position, and once the door is stopped, gravity will act to return the member 100 to the rested position. Still another preferred mode shown in FIG. 29*b* employing a flexible member 111 extending from the bracket 110 to the member 100 acting as a type of living hinge.

FIG. 32 and FIG. 33 show exploded and assembled views of still yet another preferred mode of the device 10 wherein the device 10 is intended for employment near the hinged side edge of a door (FIG. 34). As is shown a first elongated member 118 having a ramped portion 120 and second elongated member 124 are rotationally engaged to a bracket component 128 via a pin 134 communicated through respective apertures 122, 126 to an engagement portion 132 of the bracket 128, such as a threaded aperture. In FIG. 33, a first spring 136 is included to provide a rotational biasing means on the members 118, 124 toward a protruding portion 130 on the bracket 128, acting as a stop. Additionally, a second spring 138 is included to provide a biasing force on the second member 124 relative the rotational movement of the first member 118.

FIG. 34 shows the device 10 in the first position engaged near the hinged side edge of a door 1000. The bracket 128 may be engaged to the door 1000 by any means known in the art. As the door 1000 is closed at a high velocity, shown in FIG. 35, the ramped portion 120 of the first member 118 contacts the door jamb stop 1020 deflecting the member 118 downward and away from the first position. At that instant, due to the high rate of impact, the second member 124 is essentially unable to catch up with the rotation of the first member 118 and engages the door jamb stop 1020. As such, the second member 124 provides a stop between the door 1000 and frame 1010 preventing further closure of the door and possible damage to the door jamb stop 1020. Once the momentum of the closing door is stopped, the second spring 138 provides a biasing force to the bias the second member 124 in a downward rotated position adjacent the first member 118 as shown. As the door 1000 is opened the first spring 136 will bias the members 118, 124 back to the first position shown previously in FIG. 34.

In other preferred modes not shown, the first member 118 and second member 124 may be engaged to a bracket and other mounting components as to position the second member 124 in the space between the door 1000 and door jamb frame stop 1020 and then articulate both members away from that space after providing a stop between the door 1000 and frame 1010. In this mode the ramped portion of the first member 118 may be at a compound angle, or have a complex curvature as needed.

FIG. 37-38*d* depict views of a preferred mode of the device 10 in the as used position engaged near the handle side edge of a door 1000 which is powered and automatic. In this mode and other modes described shortly below, the device includes door stop components which are automated by electronic controls to automatically deploy the stopper element 146 after a prolonged closure of the door, to thereby allow the door to be closed and the protective stopper 140 automatically deployed on the next opening of the door.

This is especially important in instances where the device 10 may be deployed, such as a hotel, or the exterior doors of a windy venue. The doors at a point may be closed for the evening for security or to keep out cold weather. With other modes of the device 10 and prior art, a user had to actively re-deploy the stopper 176 which prevents full closure of the door into the jamb. Should the deployment be delayed or forgotten when the door is left open, injuries might result to hands, digits, and limbs of persons or animals unlucky enough to have such in between the door and jamb upon a slamming of the door caused by a gust of wind or someone leaning on the door or otherwise. Employing the mode of the device 10 herein, this problem is eliminated by the automatic re-deployment of the stopper, shown as 146, 176, and 210, to a protective position, once the door is opened.

The device 10 includes a housing 140 defined by a plurality of sidewalls 142 and having an elongated aperture 144 formed on at least one sidewall 142. As can been seen, a stopper element 146 extends from within the housing 140 through the aperture 142 in a first or rested position. The stopper 140 is engaged to an arm member 150 which is rotationally engaged within the housing 140 by a hinge 154. At the proximal end, opposite the stopper 146, the arm 150 is rotationally engaged to the distal end of the actuator arm 158 of an electronic linear actuator 156. The linear actuator itself is rotationally engaged to the housing 140 similarly by a hinge 157 or the like.

In use, similar to other modes of the device 10 shown and described previously, with the device 10 in the rested position show in FIG. 37, as the door 1000 is slammed shut, the stopper 146, extending past the door edge, will contact the door jamb frame first, providing a bump stop, and prevent the door 1000 from closing further and slamming against and damaging the door jamb frame and from injuring the hand or fingers or other body part of a human or animal which might be in-between the door and jamb during a slam.

Immediately after contact of the stopper 146 with the door jamb frame, a sensor or switch 148 engaged to or in communication with a sensing component of the stopper 146 will close a circuit and thereby activate the linear actuator 156 causing the arm 150 and stopper 146 to rotate upward to essentially draw the stopper 146 into the interior of the housing 140, as shown in FIG. 38*c*. As can be seen, by drawing the arm 150 and stopper 146 into the housing 140, the stopper 146 will no longer extend past the handles side edge of the door 1000 such that the door 1000 can now achieve a fully-closed position.

After the device 10 has successfully prevented the door 1000 from slamming and provided a means for providing a full closure without damage to the frame, it is desired to essentially reset the device 10 while the door is in the fully closed position to allow the device 10 to once again return to the as used or first position. In accordance with the current preferred mode of the device 10, this is accomplished by timing, or otherwise providing a means for activating the linear actuator 156 to rotate the arm 150 back to the rested position. Shown in FIG. 38*d*, the translation of the actuator arm 158 has returned the stopper arm 150 to the rested position. However, since it is noted that at this time the door 1000 is in a conventional closed position, the aperture 144 of the housing 140 will be positioned adjacent the door jamb frame preventing the stopper 146 from extending out from it until an opening of the door.

As such, it is shown and preferred that the arm 150 is formed of a two-piece construction having a rotatable hinge portion 152 allowing the stopper end of the arm 150 to be deflected to the stored, or loaded position shown. The device 10 will remain in the position of FIG. 38*d* until the door 1000 is once again opened and the housing 140 is clear of the door jamb frame such that gravity will cause the stopper-engaged end of the arm 150 to rotate back to the as-used first position of FIG. 38*a*. Gravity will cause the redeployment or alternatively the hinge 152 can be spring loaded to bias the stopper-engaged end of the arm 150 to the first position. It must be noted that the device 10 employing electronic components additionally includes the proper power source 164 and other circuitry 162 needed to accomplish the above detailed tasks.

FIG. 39*a*-39*d* show another automated mode of the device 10 employing purely linear translation to prevent a high velocity closing door from slamming into a door jamb stop as well as to provide controlled closure of the door thereafter. Shown, the device 10 again includes an elongated housing 170 defined by a plurality of sidewalls 172 and having an aperture 174 formed on at least one sidewall 172. As can been seen, a stopper element 176 extends from within the housing 170 through the aperture 172 in a first or rested position. The stopper 170 is engaged to an arm member 180 comprising of a first and second 182, 184 telescopically engaged components. It is preferred that the second component employs a spring (not shown) or other means for biasing the first component 182 in the extended or rested position as shown in FIG. 39*b*. At the proximal end, opposite the stopper 17 6, the arm 180 is fixedly engaged to the distal end of the actuator arm 188 of an electronic linear actuator 186. The linear actuator itself is rigidly engaged within the housing 170 by any means known in the art.

In use, with the device 10 in the first rested position, and engaged preferably at or near the handle side edge of a door, the stopper 176 extends past the door edge and provides a bump stop against the door jamb frame for a high velocity closing door. Immediately after contact with the door jamb frame, or by compression between the fingers of a user closing the door for the evening, a switch or sensor 178 engaged to the stopper activates the linear actuator 186 as to translationally draw the arm 180 and stopper 176 within the housing 170, as shown in FIG. 39*c*.

Again, this will allow the door to achieve a fully closed position. Further, through electronic timing or other activation means, with the door in the closed position, the linear actuator 186 reverses direction and translates the arm 180 back toward the first or rested position. However, as shown in FIG. 39*d*, since the aperture 174 side edge of the housing 170 is adjacent the door jamb frame when the door is in the closed position, the stopper 176 will be unable to translate past the aperture 174 of the sidewall 172 and instead the first component 182 of the arm 180 will be translated into the telescopically engaged second component 184. As such the first component 182 and stopper 176 are in loaded or biased state to return the arm to the first position once the door is opened.

FIG. 40*a*-40*c* show another automated mode of the device 10 employing another means for linear translation of the door stop device components to prevent a high velocity closing door from slamming into a door jamb stop as well as provide controlled closure of the door thereafter. Shown, the device 10 again includes an elongated housing 200 defined by a plurality of sidewalls and having an aperture formed on at least one sidewall. Similar to other modes, a stopper element 210 extends from within the housing 200 through the aperture in a first or rested position. The stopper 210 is engaged to an arm member 202 comprising of first and second 204, 206 telescopically engaged components. It is preferred that the second component employs a spring (not shown) or other suitable means for biasing the first component 204 in the extended or rested position as shown in FIG. 40*a*. At the proximal end, opposite the stopper 210, the arm 202 is fixedly engaged to a timing belt track 208. There are also a rigidly engaged driving motor 212 and alignment wheel 214 having toothed gears corresponding to the belt track 208.

In use, with the device 10 in the first rested position, and engaged preferably at or near the handle side edge of a door, the stopper 176 extends past the door edge and provides a bump stop against the door jamb frame for a high velocity closing door. Immediately after contact with the door jamb frame, a switch or sensor engaged to the stopper 210 activates the driving motor 212 as to translationally draw the track 208 and arm 202 within the housing 200, as shown in FIG. 40*b*.

Again, as in all modes of the automatic mode of the device 10, this will allow the door to achieve a fully closed position for long periods if desired and still automatically redeploy the stopper and eliminate the possibility of someone forgetting to do so. Further, through electronic timing or other activation means, with the door in the closed position, the driving motor 212 reverses direction and translates the track 208 and arm 180 back toward the first or rested position. Again however, as shown in FIG. 40*c*, since the housing 200 will be adjacent to the door jamb frame when the door is in the closed position, the stopper 210 will be unable to translate past the aperture of the housing 200 and instead the first component 204 of the arm 202 will translate into the telescopically engaged second component 206. As such, the first component 202 and stopper 210 are in loaded or biased state to return the arm to the first position once the door is opened.

FIG. 41 shows an exploded view of yet another preferred mode of the device 10 showing the various components thereof. It is preferred that the currently shown and described mode of the device 10 is employable in a substantially vertically mounted orientation at the top or uppermost edge of a door. As such, during use, the components of the device 10 will contact the uppermost edge of the door jamb frame wherein the various components to be described shortly provide a means for preventing a high velocity closing door from slamming into a door jamb stop, maintain a distance for a time after contact, as well as provide controlled closure of the door thereafter.

The device 10 in the currently shown mode comprises a housing 220 formed of a plurality of sidewalls, a closed end, and an open end 227. Again, similar to other modes of the device 10 the housing 220 has at least one sidewall extension 222. Further, a first threaded aperture 224 and second threaded aperture 226 are shown on respective sidewalls of the housing 220 as needed to engage screws which is described in more detail later.

The components of the device 10 to be housed within the housing 220 are shown in the exploded view for descriptive purposes wherein the intended operation of the device and its components will be set forth in later figures. Further it is to be understood that the various components are capable of modifications as needed to achieve the above noted goals as is within the overall scope and intended purpose of the device 10 and should not be considered limited by the following descriptions.

In the figure there is seen the first member 228. The first member 228 is depicted as a rigid but impact absorbing body preferably of a rectangular cross section and formed of a material such as a polymeric material or rubber. The member 228 includes a ramped portion 230 communicating with at least one sidewall of the body of the member 228. It must be noted that the ramped portion 230 may similarly be a curved or otherwise angled portion as needed for the intended purpose which will become apparent shortly.

A second member 232 is also shown and comprised of a substantially rigid body preferably of a rectangular cross section. The second member 232 additionally includes at least one curved or ramped portion 236 which in the as used mode provides a means for deflecting or otherwise rotating the member 232 during high velocity impact with the door jamb frame. This action provides a means for communicating the force of impact away from the components of the device 10 and is shown in more detail in FIG. 47. There is further shown a tracking pin 234 employed to register within a track (not shown) on the underside of the first member 228.

Referring now to both the exploded view in FIG. 41 as well as the partially assembled view in FIG. 42, there is seen a bracket component 238 having clearance apertures thereon which provides a means for engaging and mounting the various components of the device 10 into a compact unit to be housed within the housing 220. Engagement of the first member 228 to the bracket 238 is provided via mounting screws 242 as well an additional mounting component 240 in combination with mounting screws 244 employed for threaded engagement thereof.

However, it must be noted that the device 10 may employ other means for engagement such as adhesives, snap fits, or the like and is not limited to screw type engagement shown. Further, there is seen a first spring engagement screw 246, spring adjustment slide 248 and drive screw 254 employed in combination with a first spring 256 which provides a means bias the bracket 238 and first member 228 in the as used position defined shortly. In use the spring 256 extends from the engagement screw 246 to a set screw 258 which is engaged within the aperture 226 of the housing 220, a clearer depiction of this is shown later in the side views of FIGS. 45-48. The adjustment slide 248 and drive screw 254 provide means for adjusting the spring tension or biasing force of the first spring 256.

The second member 232 communicates with the bracket 238 via a second spring 260. There is shown a second spring engagement screw 250, spring adjustment slide 252, and drive screw 254, wherein the spring 260 extends from the screw 250 to an engagement point with the second member 232 (not shown). The adjustment slide 252 and drive screw 254 provide means for adjusting the spring tension or biasing force of the second spring 260. As such, similar to other modes of the device 10, the first member 228 and second member 232 may translate independent each other.

FIG. 43 depicts a complete assembly of the device 10 with a limiting screw 264 communicating through the aperture 224 of the sidewall of the housing 220 and extending within a track of the first member 228 providing a means for limiting the translational range of the member 228 relative the housing 12. An adjustable screw 262 which communicates through a threaded aperture in the bracket 238 provides a means for adjusting the translational range. It should be noted that FIG. 43 currently depicts the device 10 in the as used or rested position. In this position it is particularly preferred that the distal ends of the first and second members 228, 232 respectively, are positioned extended at a distance away from the distal edge of the sidewall extension 222, and the door edge, as is clearly shown in the figure.

The following figures provide a description of the modes of operation of the device 10 engaged on the top side edge during the high velocity closure of a door 1000. FIG. 45 shows a side view of the device 10 engaged in the as used position on the top side edge of a door 1000, noting that the distal edge of the sidewall extension 222 is flush with the edge of the door 1000. The figure depicts immediately prior to the initial impact of the ramped portion 230 of the first member 228 with a strike plate member 300 shown engaged on the corner of the top or uppermost edge of the door jamb frame 1010. The strike plate 300, is preferably a durable, impact resistant material such as a metal, or plastic, however can be any suitable material.

It is noted that during closure, the top edge of the door 1000 approaches the top edge of the door jamb frame 1010 at a slight angle of attack due to rotational movement. As such it is preferred that the strike plate 300 is angled or otherwise formed to assure flush contact of the face of the first member 228 with the face of the strike plate 300 during impact. Further, it is to be understood that the strike plate 300 may be permitted to pivot, or otherwise be set for optimal engagement in a manner which best transfers the impact force of the high velocity closing door 1000 the door jamb frame 1010.

A moment after impacting the door jamb, shown in FIG. 46, the first member 228 is deflected by the force of the impact, to translate away from the door edge and frame 1010, causing a stretching of the first spring 256 and additionally the second spring 260. It is preferred that any contact surface between the first member 228 and second member 232 be substantially low friction such as to allow the first member 228 to be deflected without essentially dragging the second member 232 along with it. Further, a slightly higher friction contact surface between the second member 232 and the interior of the housing 220 may be provided to aid in the delay or dwell time in its extended position.

Subsequent to translation of the first member, with the second member 232 remains substantially in an extended position or stationary, as shown in FIG. 47. Upon further closure of the door 1000, the leading surface of the second member contacts the strike plate 300 and the second member 232 acts as a stop between the door 1000 and strike plate 300. This stop is formed for a dwell time which the second member 232 remains extended and provides a means for communicating some of the force of the closing door 1000, into the stronger door jamb frame 1010, further preventing damage to the door jamb stop 1020. Further, the second member 232 dwelling in the extended position, maintains its blocking or in-use position, thereby maintaining a gap between door and frame for a duration of time determined by the dwell time of the second member 232 in the extended position blocking closure into the jamb. This dwell time is adjustable by adjusting the achieved amount of spring force in the second spring 260 as well as the frictional contact between the first and second member and the second member and the housing, to increase or decrease the force of the bias.

As can also be seen, a ramped or curved portion 236 at the end of the second member 232 closest to the retracted first member 228, provides an important function in that it allows the second member 232 to pivot or deflect slightly in a direction away from the door jamb, on impact. This defection causes the curved portion 236 to ride on the first member 228 and absorbs impact energy and aids in minimizing the transfer of energy directly into the assembled components of the device 10. It has been found that this pivoting of the second member 232 and resulting energy absorption significantly reduces the chance of damage to the housing 220. This is because instead of a long lever being formed by the extended second member 232 transmitting all the torque of impact to the housing 220, the vector of the force of impact is communicated in an angled vector relative to the face of the door to which the housing 220 engages and dissipated, thus reducing the chance of damage to the housing or a dismount from the door.

With the door's 1000 momentum stopped, and the door held open a gap for an adjustable duration of time, any body part or other item in the maintained gap, can be withdrawn. Thereafter the biasing force from the stretched second spring 260, which has been elongated by the moving mount to the first member, provides the biasing force to translate the second member 232, away from the edge of the door, and along the housing 220 and to a position adjacent the first member 228, shown in FIG. 48.

Additional utility of the depicted device 10 of the current preferred mode, is provided in a substantially vertically disposed mounting of the device 10, with vertical translation of the first and second member. Used in a vertical disposition, translating parallel to the long side of the door, should the second spring 260 fail to impart bias, gravity will act to bias the second member 232 to translate toward the housing 220 as needed, to allow the door 1000 to safely close. This gravitational bias and translation occurs once the force of the door jamb against the side of the second member 232 is frictionally insufficient to maintain it extended.

In use on a moving door, normally once the first member retracts, the impact of the jamb on the second member 232 causes a rebound of the second member 232 away from the door jamb. Frictional engagement is lost during the disconnect caused by the rebound, and gravity will aid translation of the second spring 260 is functional, and will cause the translation by itself should the second spring 26 be damaged, disconnected, or missing. This gravitational secondary biasing is highly desirable as a fail safe mechanism of the current mode of the device 10 to allow closure of doors, such as fire sealing or water tight doors that must be allowed to close during certain emergency situations.

As is the intent of the present invention, subsequent to the dwell time of the second member 228 in an extended position, and the resulting maintaining of a gap between the door edge and frame, a slow controlled closure of the door 1000 into the frame, is then achievable. Closure into the frame is shown in the current figure, where the ramped portion 230 at the distal leading edge of the first member 228, is shown contacting the door jamb stop 1020.

As noted, in many instances of a high velocity door closure, where the second member 232 contacts the door jamb, or wall surface for a dwell time in the extended position, a rebound occurs which separates the second member 232 from frictional engagement with the door jamb or contact surface. During this disconnect, the biasing force of the second spring 260 will translate the second member to a retracted position.

It should be noted that in addition to adjusting the biasing force of the second spring 260 to increase or decrease dwell time and the resulting formed gap, the material forming the second member 232 may also be adjusted for durometer, to make it more or less resilient. This is most important for two reasons. First, the resilient material absorbs the extreme force of the contact of the door and the edge between it, without communicating that force to the housing which would dismount it. Instead, the resilient material absorbs it. Currently nylon and delron, and materials of similar durometer are employed but this can be adjusted to absorb more or less force.

Secondly, the durometer of the material forming the second member can be adjusted for more or less resilience, and thereby adjust the distance of any rebound. The time of rebound can be adjusted to increase or decrease the dwell time of the gap between the leading edge of the door 1000 and the leading edge of the door jamb. The size of the rebound also increases the size of the gap momentarily. Consequently the device used for doors at slamming speeds, from 4 to 50 feet per second (and as also defined by ANSI for door specifications), bumps, rebounds, and then closes at a conventional speed, all the while maintaining a gap for a dwell time. Thus, while the second member may retract quickly due to an increased bias of the second spring 260, the duration of existence of the gap can be made slightly longer using material with a durometer which absorbs punishment and transmission of damaging force to the housing, and provides a bounce or rebound separation through movement in a direction away from the door jamb, before the door 1000 returns to its former directional movement to a normal closure at a normal speed between 1-3 feet per second approach speed of the door to the jamb, where both members retract concurrently. Currently a shore of between 45 and 120 works well for the material such as nylon or delron which are on the higher side of the shore scale.

Shown in FIG. 49, the first member 228 has been deflected and translated in a direction away from the leading edge of the door 1000 toward the hinged side of the door 100 by the force of the contact with the stop 1020 during the forward travel of the door to a closed position. This translation away from the door edge, stretches the first spring 256, and concurrently stretches the second spring 260 which are engaged to a mount moving in the direction of translation of the first member 228. The second member 232 lacking the ramped distal end to initiate translation, remains in an extended, or as-used position, extended past the leading edge of the stop 1020 for a dwell time, and acts as a momentary stop between a contact between the leading edge of the door 1000 and door jamb stop 1020.

Here again, the dwell time of the second member 232 in an extended position, maintains the gap for a duration of time substantially equal to the dwell time of the second member if not slightly longer. Thereafter, the biasing force of the spring and then a controlled closure of the door 1000, shown in the final closed position in FIG. 50. In the position as shown, the first spring 256 is in a substantially stretched state and storing energy and imparting a translational bias toward the leading edge of the door 100. Consequently, when the door 1000 is opened, the components will return to the first position shown in FIG. 45 ready to maintain a gap and prevent injury.

It is must be noted, and is highly emphasized, that in the case of conventional slow closure of the door 1000, the first and second members 228, 232 will tend to translate in unison due to frictional engagement therebetween and the lack of energy to accelerate the first member 228 using the force vector caused by the contact of the door jamb with the ramped distal end. A high speed contact between the ramped distal end and door jamb translates the first member 228 with sufficient force and speed that frictional contact with the second member 232 is overcome thereby leaving the second member 232 in the extended position for contact to maintain a gap.

However, during a slow closure of the door 1000, with the device 10 in the starting first position of FIG. 45, upon contact of the ramped portion 230 of the first member 228 with the strike plate 300 at a slow velocity, both members 228, 232 have sufficient frictional contact along mating surface such that they will be deflected in unison. During such a concurrent translation by both members away from the leading edge of the door, only the first spring 256 in compressed, and the device 10 then achieves the cocked position shown in FIG. 48. Upon further closure, the members will translate in a direction away from the hinged side of the door, and will then achieve the position shown in FIG. 50.

As an additional note, the device 10 in any of the preferred modes shown may employ means for locking or otherwise securing the bump stop and closure components in any of the positions shown. For example, through the provision of a locking pin, locking button, frictional lock, or other suitable means (not shown), the device 10 can be securely maintained in the position shown in 46 with the second member 232 is positioned to always contact the strike plate 300 when the door 1000 approaches the door jamb. Alternatively, the securing means can lock or otherwise secure the first and second member 228, 232 in the closed or stored positioned of FIG. 50, such that the door 1000 will always be permitted to close conventionally.

FIG. 51 shows a partially exploded view of still yet another particularly preferred mode of the invention. The device 10 in the currently shown mode comprises a housing 270 in translational engagement with the two members as in other modes. As shown the housing 270 has a plurality of sidewalls and an open end 272. The housing 270 as shown includes at least one sidewall extension 274 and having an additional right angle extension 276 or lip engaged to and extending therefrom at an angle substantially normal to the plane of the sidewall. The right angle extension 276 provides a means for engaging the housing 270 on the upper terminating edge of a door (shown later). Also shown is a raised lip portion 278 disposed near the terminating edge of the sidewall extension 274, which provides a means for configuring the device 10 into a stored position. This is shown in more detail later.

The first elongated member 282 has a ramped portion 286 and the second elongated member 288 is shown in the assembled mode therewith engaged via similar components as shown previously in FIG. 41. However, in the current mode, the second member 288 includes a transverse slit 284 located on the uppermost terminating surface (uppermost referring to the orientation when the device is positioned as shown in FIGS. 52-61). The slit 284 provides a means for absorbing energy as is set forth later in this disclosure.

Further, in this current mode the first member 282 includes a side cavity 290 for housing a adjustable projection stopper 296 and threadably engaged adjustment screw 294. As is shown the adjustable stopper 296 includes a threaded aperture 297 for threaded engagement with the screw 294. In use, as shown in the side view of FIG. 52 and in the cut-a-way side view of FIG. 53, the limiting screw 280 engages the projection stopper 296. The position of the stopper 296 dictates the maximum projection of the elongated member 282, 288 from the housing 270. The user may simply turn the adjustment screw 294 to translate the stopper 296 to any desired translational position with the housing 270.

For example, in FIG. 53 the stopper 296 is in a first position wherein the elongated members 282, 288 projection past the sidewall extension 274. In this configuration the device 10 will perform as previously shown in FIGS. 45-50 wherein the elongated member 282, 288 contact the door jamb frame upon initial impact.

Additionally preferred, the adjustable stopper 296 allows the user to adjust the projection of the elongated members 282, 288 to a position substantially flush with the right angled extension 276 as shown in FIG. 54, and shown engaged to a door 1000 in FIG. 55. In this position, the elongated members 282, 288 will be configured to clear the door jamb frame 1010 however will engaged to door jamb stop 1020 upon closure of the door 1000.

In FIG. 56, the operative employment of the lip portion 278 is shown configuring the device 10 in the store position. To achieve the store position, the user simply pushes down on the elongated members 282, 288 and essentially wedges the second member 288 against the lip 278, preventing the members 282, 288 from projecting past the location of the lip 278. As such when engaged to a door 1000 as shown in FIG. 59, the elongated members 282, 288 will be positioned to clear the door jamb frame 1010 and door jamb stop 1020 so the door 1000 can close in a conventional manner (FIG. 60).

However, to ensure that the device 10 is reset to the as used position upon an opening of the door 1000, a failsafe reset means is provided through the employment of a flexible planar member 300 engaged onto the contact surface of the door jamb stop 1020. The planar member 300 is shown in front and side views of FIG. 57 and FIG. 58 respectively. In use, as the door 1000 is opened (FIG. 61) the planar member 300 engages the transverse slit 284 of the second member 288. As the door 1000 is continued to be opened, the engagement of the second member 288 with the planar member 300 essentially pulls the second member 288 away from the wedged engagement with the lip 278, and once the door 1000 clears the door jamb frame 1010, the elongated members 282, 288 are permitted to reset to the as used position to the projection distance dictated by the adjustable stopper 296 (FIG. 55).

It is anticipated that the elongated members of the device 10 will encounter high impact forces. As such, in FIG. 62 and FIG. 63 there is seen another preferred mode of the second elongated member 310 having means for shock absorption and resulting energy dissipation. As noted, the components depicted in the various modes of the device herein can be employed in combination with other modes of the device wherein they are not depicted.

As shown in FIGS. 62-62, included are a plurality of detents 304 disposed into the surface 303 of the second member in a position adjacent the distal end of the first elongated member 302. The detents 304 allow the first elongated member 302 to flex slightly toward the second member 310 upon an impact with a door jamb frame or stop. This flexure will ensure that the first member 302 does not crack, since impact energy will be transmitted to cause the elastic flexure. Further, there is seen a transverse angled slot 306 communicating through the body of the second member 310. The slot 306 will additionally permit flexure or deformation of the material forming the second member 310 elastically into the void of the slot 36, as a kind of shock absorber. The slot 306 may be disposed at an angle complimentary to the ramped portion 308 of the first member 302.

FIG. 64-68 show yet another particularly preferred mode of the invention. The device 10 in the currently shown mode comprises a housing 312 comprised of a plurality of sidewalls, a closed end, and an open end 314. The housing 312 as shown includes at least one sidewall extension 316 and having an additional right angle extension 318 engaged to and extending therefrom. The right angle extension 318 provides a means for engaging the housing 312 on the upper terminating edge of a door as shown in previous figures. Also shown is a recessed cavity 320 disposed near the terminating edge of the sidewall extension 316, whose purposes is described in more detail later.

The first 322 and second 324 elongated members are also shown. In this mode, the first member 322 includes an ramped portion 323 which additionally comprises a transverse convex curvature communicating from one side edge to the other, as can be seen in FIG. 64. This curvature provides a means for mating the leading edge of the first member 322 of the device 10 for a surface with a parallel impact with the door jamb at angles which are not parallel to the face of the first member 322.

This curvature is preferred for the as used mounting of the device 10 in all modes at the top edge of the door, since the rotating door will be closing in an arc toward the door jamb yielding a contact between the two at a slight or moderate angle, were the surface of the second member 32 planar. Thus, the curvature accommodates this angle, and provides a means to increase the surface contact between the door jamb and first member 322. The increased surface area of contact, helps prevent marring of the door jamb, and also prevents damage to the first member 322 by distributing the force of contact over a larger area.

Further, there is shown and preferably included a friction enhancing component 332 which is engaged within a cavity 338 (FIG. 65) of the second member 324. A retainer pin 336 is also provided as a means for securing the friction enhancing component therein. Shown more clearly in the assembled cross sectional view of FIG. 68, the friction enhancing component 332 comprises a distal end 334 which extends from the cavity 338 and communicates with the recessed cavity 320 on the wall extension 316. An adjustment screw 328 is provided and can be selectively tightened or loosed to increase or decrease the frictional biasing engagement of the distal end 334 against the wall of the cavity 320.

Thus, this engagement serves as a "toe hold" which will inhibit the retraction and translation of the second member 324 relative the first member 322 during operative translation of the first member 322 into the housing 312 after contact with the door jamb frame and/or stop as shown in previous modes. Tightening of the adjustment screw 328 will increase the resistance of the second member 324 to translate, thereby maintaining the second member 324 in an extended position for a longer period of time therefor providing a means for increasing the likelihood of a bump stop prior to closure of the door.

An additional adjustment screw 326 is also provided and communicates through an aperture 340 of the second member 324 to at least one booster spring 330. In use, the screw 326 provides a means for adjusting the compression of the spring 330 in its engagement with the first 322 and second 324 member. In use, the booster spring 330 is compressed when the first member 322 is translated into the housing 312, such as during the impact with the door jamb frame.

As can be seen in FIG. 68, a gap 333 is provided between the spring 330 and the first member 322 such that the spring 330 will not compress until the first member 322 translates the distance of the gap 333. This distance is set and can be shortened by a tightening adjustment screw 326 which translate the spring 330 to close the gap 333. By closing the gap 333, the first member 322 will contact the booster spring 330 sooner such that the compression of the booster spring 330 provides a means for enhancing the effect of the additional springs 331 by causing a greater downward pulling force on the second member 324 by the first member 322, and into the housing 312. Adjusting the screw 326 increases or decreases the effect of the booster spring 330. The housing 312 includes a aperture 342 which allows a user to insert a screw driver or other tool for selectively tightening or loosening the adjustment screws 326, 328 as needed. It is noted that an increased effect of the booster spring 330 is often desired if the door jamb stop employs a weather stripping which is conventional formed of rubber and tends to increase the friction and therefor resistance of the second member 324 from translating from the contact with the door jamb stop to the position within the housing 312.

FIG. 69-73 show additional preferred modes of the device 10 comprising a housing 344 comprised of a plurality of sidewalls 346 and having at least one open end 348. In this mode a right angled extension 350 is provided as a means for engaging the housing 344 on an upper terminating edge of a door 4100. However, in this mode the extension lies substantially inline with the plane of the open end 348 of the housing 344. This mode is especially adapted for employment with doors 4100 and door frames 4000 which are conventionally seen in ships and other type vessels. These type doors 4100 and frames 4000 are typically formed form metal, and the door 41000 includes a recessed portion 4110 at the terminating edge which conventionally employs weather stripping or the like providing a means for a sealed and weatherproof closure against the frame 4000, as is desired in ships and sailing vessels.

Experimentation has shown that the configuration of these type doors requires slight modification from the previous modes of the device 10 already disclosed. In this mode the second elongated member 354 includes at least one curved or ramped portion 358 which in the as used mode provides a means for deflecting or otherwise rotating the member 354 during high velocity impact with the door jamb frame 4000 (FIG. 72). In addition, the second member 354 includes a lip portion 356 extending from the top surface (top referring to the orientation of the device 10 in the as used mode engaged to the top edge of a door (FIGS. 71-73). The lip portion 356 allows the door 4100 to close fully against the frame 4000 as shown in FIG. 73 however providing a means for maintaining the device 10 in a ready-use position.

Briefly, following FIGS. 71-73, the closure of the door 4100 causes the first member 352 to contact the frame 4000 thereby deflecting the first member 352 into the housing 344. In a high speed closure, the second member 354 will maintain an extended position such that the second member 354 will provide a bump stop between the frame 4000 and door 4100 (FIG. 72). As the doors momentum is taken away by the bump stop, the second member 354 is then drawn into the housing 344 due to the elastic communication with the first member 352 (provided by springs as shown in previous modes).

Finally, upon closure of the door 4100 (FIG. 73), the lip 358 prevents the members 352, 354 from extending past the edge of the frame 4000, which would otherwise block the door from reopening or cause the device 10 to disengage from the door 4100 and possibly damage it when the door is pulled open. As such, after opening of the door 4100 from position shown, the device 10 will return to the as used position shown in FIG. 71. Again however it is noted that in a slow speed closure of the door 4100, the first and second members 352, 354 will translate in unison as the first member 352 is deflected by the contact with the frame 4100 without the bump stop of the second member 354.

It is noted that upon reading this disclosure that those skilled in the art may readily understand various other ways to achieve translation or rotation of a stopper to and away from a door edge as is the intended scope of the present invention. As such those skilled will appreciate that the above description are provided merely to portray the overall purpose of the device and should therefor not limited to the exact mechanical and electronic operations described. Further it is noted and anticipated that the operations of the device 10, while not preferred for esthetics and other reasons, as shown could be employed through an engagement or retrofitting of operative components directly to a door frame, as opposed to the door, and the actions of the bump stop and dwell time of the second member to yield a gap and subsequent controlled closure will similarly be accomplished through the contact of the door to the frame, without the need to engage the device to the door.

The above descriptions of the preferred modes have been provided to portray the intent and overall scope of the present invention. The invention provides a means for preventing injuries to users or bystanders from contact between the leading edge of a door and a door dam during a high velocity door closure from compression and/or pinching between the door and jamb. Further it provides a means for protecting the structural integrity of a door jamb stop which may be damaged from high impact forces. The device concurrently allows for normal controlled closure of the door into the door jamb.

While all of the fundamental characteristics and features of the invention have been shown and described herein, with reference to particular embodiments thereof, a latitude of modification, various changes and substitutions are intended in the foregoing disclosure and it will be apparent that in some instances, some features of the invention may be employed without a corresponding use of other features without departing from the scope of the invention as set forth. It should also be understood that various substitutions, modifications, and variations may be made by those skilled in the art without departing from the spirit or scope of the invention. Consequently, all such modifications and variations and substitutions are included within the scope of the invention as defined by the following claims.

What is claimed is:

1. A device for preventing slamming of a door in a door frame, the device comprising:

a mounting member having a mounting surface configured to be coupled to one of a vertically-extending surface of the door and a vertically-extending surface of the door frame;

a blocking member movably engaged with the mounting member, the blocking member being movable relative to the mounting member in at least a first direction between a first extended position and a second retracted position along the first direction; and a control member movably engaged with the blocking member, the control member being movable in at least the first direction from a home position to a displaced position relative to the blocking member upon contacting with the other one of the surface of the door and the surface of the door frame during closing of said door, wherein the movement of an attempted closure of the door at a first velocity above a threshold velocity causes the control member to move at least initially to the displaced position relative to the blocking member while the blocking member remains at least temporarily in the first extended position such that the blocking member prevents complete closure of the door, and wherein the movement of an attempted closure of the door at a second velocity below the threshold velocity causes both the control member and the blocking member to move substantially simultaneously in the first direction until the blocking member is in the second retracted position such that the blocking member does not prevent the door from closing.

2. The device of claim 1, wherein the first direction is generally parallel to the mounting surface of the mounting member.

3. The device of claim 1, wherein the control member comprises a ramp, wherein a first contact between the ramp and the door, if the mounting member is coupled to the surface of the door frame, or a first contact between the ramp and the door frame, if the mounting member is coupled to the surface of the door, communicates an impact force to the control member along a vector running in the first direction.

4. The device of claim 1, wherein, when the mounting member is coupled to the surface of the door and the blocking member is in the first extended position, the blocking member protrudes past a leading edge of the door.

5. The device of claim 1, wherein, when the mounting member is coupled to the surface of the door, the blocking member in the first extended position relative to the mounting member, and the door in an almost-closed position, at least a portion of the blocking member is disposed horizontally between the door frame and a plane parallel to the surface of the door frame.

6. The device of claim 1, wherein, during an attempted closure of the door at the first velocity, movement of the blocking member in the first direction is at least temporarily inhibited by frictional engagement between the blocking member and the mounting member.

7. The device of claim 1, further comprising a friction enhancing member, the friction enhancing member having an adjusting member to adjust a level of frictional engagement between the blocking member and the mounting member during an attempted closure of the door at the first velocity.

8. The device of claim 7, wherein adjustment of the level of friction of the friction enhancing member effectively adjusts the magnitude of a velocity defining the threshold velocity.

9. The device of claim 1, wherein the control member is configured to return from the displaced position to the home position relative to the blocking member by a biasing means if the door rebounds after the attempted closure of the door at the first velocity.

10. The device of claim 1, further comprising a biasing member configured to bias the control member from the displaced position toward the home position relative to the blocking member if the door rebounds after the attempted closure of the door at the first velocity.

11. The device of claim 10, wherein the biasing member comprises a spring.

12. The device of claim 11, wherein adjusting a spring force of the spring affects the magnitude of a velocity defining the threshold velocity.

13. The device of claim 1, further comprising a biasing member configured to bias the blocking member from the first position toward the second position, at least when the blocking member is in the first position and the control member is in the displaced position relative to the blocking member.

14. The device of claim 13, further comprising a second biasing member configured to bias the blocking member toward the second position, at least when the blocking member is in an intermediate position between the first position and the second position and the control member is in partially displaced position between the home position and the displaced position relative to the blocking member.

15. The device of claim 1, wherein the blocking member is pivotable with respect to the mounting member about a first axis, at least with the blocking member in the first position and the control member in the displaced position, the first axis extending parallel to the surface to which the mounting member is coupled.

16. The device of claim 1, wherein the control member is pivotable with respect to the blocking member about a second axis, at least with the blocking member in the first position and the control member in the displaced position, the second axis extending parallel to the surface to which the mounting member is coupled.

17. The device of claim 1, wherein the threshold velocity is no greater than 3 feet per second.

18. A device for preventing slamming of a door in a door frame, the device comprising:

means for coupling the device to a vertically-extending surface of the door or a vertically-extending surface of the door frame;

means for at least initially preventing closure of the door in response to an attempted closure of the door at a first velocity above a threshold velocity, the preventing means being movable relative to the coupling means in at least a first direction parallel to the vertically-extending surface to which the device is coupled;

means for moving the preventing means in the first direction from a blocking position, in which closure of the door is prevented, to a clear position, in which closure of the door is allowed, in response to an attempted closure of the door at a second velocity below the threshold velocity.

19. The device of claim 18, further comprising means for biasing the preventing means from the blocking position toward the clear position immediately after the attempted closure of the door at the first velocity.

20. The device of claim 18, further comprising means for biasing the preventing means from the clear position toward the blocking position after closure and subsequent opening of the door.

21. A method of preventing slamming of a door in a door frame, the method comprising:

providing a mounting member configured to be coupled to a vertically-extending surface of the door or a vertically-extending surface of the door frame;

providing a blocking member movably engaged with the mounting member, the blocking member being movable relative to the mounting member in at least a first direction between a first position and a second position along the first direction; and providing a control member movably engaged with the blocking member, the control member being movable in at least the first direction from a home position to a displaced position relative to the blocking member such that, with the mounting member coupled to the surface of the door or the surface of the door frame and with the blocking member in the first position relative to the mounting member, an attempted closure of the door at a first velocity above a threshold velocity causes the control member to move at least initially to the displaced position relative to the blocking member while the blocking member remains at least temporarily in the first position such that the blocking member prevents complete closure of the door, and an attempted closure of the door at a second velocity below the threshold velocity causes both the control member and the blocking member to move substantially simultaneously in the first direction until the blocking member is in the second position such that the blocking member does not prevent the door from closing.

22. The method of claim 21, further comprising adjusting the threshold velocity by adjusting a friction enhancement member configured to adjust a level of frictional engagement between the blocking member and the mounting member during an attempted closure of the door at the first velocity.

* * * * *